US008214216B2

(12) United States Patent
Sato

(10) Patent No.: US 8,214,216 B2
(45) Date of Patent: Jul. 3, 2012

(54) SPEECH SYNTHESIS FOR SYNTHESIZING MISSING PARTS

(75) Inventor: Yasushi Sato, Fukuoka (JP)

(73) Assignee: Kabushiki Kaisha Kenwood, Hachiouji-shi, Tokyo (JP)

( * ) Notice: Subject to any disclaimer, the term of this patent is extended or adjusted under 35 U.S.C. 154(b) by 1464 days.

(21) Appl. No.: 10/559,571

(22) PCT Filed: Jun. 3, 2004

(86) PCT No.: PCT/JP2004/008087

§ 371 (c)(1),
(2), (4) Date: Dec. 5, 2005

(87) PCT Pub. No.: WO2004/109659

PCT Pub. Date: Dec. 16, 2004

(65) Prior Publication Data

US 2006/0136214 A1 Jun. 22, 2006

(30) Foreign Application Priority Data

Jun. 5, 2003 (JP) ..... 2003-160657
Apr. 9, 2004 (JP) ..... 2004-142906
Apr. 9, 2004 (JP) ..... 2004-142907

(51) Int. Cl.
*G10L 13/08* (2006.01)
*G10L 21/04* (2006.01)

(52) U.S. Cl. ..... 704/258; 704/263; 704/267

(58) Field of Classification Search ..... 704/258, 704/260, 265, 266, 267, 268, 269, 263
See application file for complete search history.

(56) References Cited

U.S. PATENT DOCUMENTS 5,636,325 A * 6/1997 Farrett ..... 704/258
5,682,502 A * 10/1997 Ohtsuka et al. ..... 704/267
(Continued)

FOREIGN PATENT DOCUMENTS

EP 1 100 072 * 5/2001
(Continued)

OTHER PUBLICATIONS

International Preliminary Report on Patentability dated Mar. 9, 2006 for Application No. PCT/JP2004/008087.

(Continued)

*Primary Examiner* — Martin Lerner
(74) *Attorney, Agent, or Firm* — Eric J. Robinson; Robinson Intellectual Property Law Office, P.C.

(57) ABSTRACT

A simply configured speech synthesis device and the like for producing a natural synthetic speech at high speed. When data representing a message template is supplied, a voice unit editor (5) searches a voice unit database (7) for voice unit data on a voice unit whose sound matches a voice unit in the message template. Further, the voice unit editor (5) predicts the cadence of the message template and selects, one at a time, a best match of each voice unit in the message template from the voice unit data that has been retrieved, according to the cadence prediction result. For a voice unit for which no match can be selected, an acoustic processor (41) is instructed to supply waveform data representing the waveform of each unit voice. The voice unit data that is selected and the waveform data that is supplied by the acoustic processor (41) are combined to generate data representing a synthetic speech.

12 Claims, 9 Drawing Sheets

U.S. PATENT DOCUMENTS

| | | | | |
|---|---|---|---|---|
| 5,696,879 | A * | 12/1997 | Cline et al. | 704/260 |
| 5,740,320 | A * | 4/1998 | Itoh | 704/267 |
| 5,864,812 | A * | 1/1999 | Kamai et al. | 704/268 |
| 5,905,972 | A * | 5/1999 | Huang et al. | 704/268 |
| 5,909,662 | A * | 6/1999 | Yamazaki et al. | 704/221 |
| 6,035,272 | A * | 3/2000 | Nishimura et al. | 704/258 |
| 6,185,533 | B1 * | 2/2001 | Holm et al. | 704/267 |
| 6,212,501 | B1 * | 4/2001 | Kaseno | 704/258 |
| 6,360,198 | B1 * | 3/2002 | Imai et al. | 704/207 |
| 6,405,169 | B1 * | 6/2002 | Kondo et al. | 704/258 |
| 6,446,041 | B1 * | 9/2002 | Reynar et al. | 704/260 |
| 6,708,154 | B2 * | 3/2004 | Acero | 704/260 |
| 6,778,962 | B1 * | 8/2004 | Kasai et al. | 704/266 |
| 6,810,379 | B1 * | 10/2004 | Vermeulen et al. | 704/260 |
| 6,823,309 | B1 * | 11/2004 | Kato et al. | 704/267 |
| 6,826,530 | B1 * | 11/2004 | Kasai et al. | 704/258 |
| 7,082,396 | B1 * | 7/2006 | Beutnagel et al. | 704/258 |
| 7,113,909 | B2 * | 9/2006 | Nukaga et al. | 704/258 |
| 7,139,712 | B1 * | 11/2006 | Yamada | 704/266 |
| 7,224,853 | B1 * | 5/2007 | Moni | 382/300 |
| 7,240,005 | B2 * | 7/2007 | Chihara | 704/267 |
| 7,257,534 | B2 * | 8/2007 | Saito et al. | 704/260 |
| 7,496,498 | B2 * | 2/2009 | Chu et al. | 704/4 |
| 7,630,883 | B2 * | 12/2009 | Sato | 704/207 |
| 7,647,226 | B2 * | 1/2010 | Sato | 704/260 |
| 2002/0120451 | A1 * | 8/2002 | Kato et al. | 704/258 |
| 2002/0156630 | A1 * | 10/2002 | Hayashi et al. | 704/258 |
| 2003/0097266 | A1 * | 5/2003 | Acero | 704/260 |
| 2004/0215462 | A1 * | 10/2004 | Sienel et al. | 704/260 |
| 2005/0049875 | A1 * | 3/2005 | Kawashima et al. | 704/266 |
| 2006/0106609 | A1 * | 5/2006 | Saito et al. | 704/260 |
| 2007/0100627 | A1 * | 5/2007 | Sato | 704/260 |
| 2008/0109225 | A1 * | 5/2008 | Sato | 704/260 |
| 2009/0326950 | A1 * | 12/2009 | Matsumoto | 704/265 |

FOREIGN PATENT DOCUMENTS

| | | |
|---|---|---|
| JP | 61-059400 | 3/1986 |
| JP | 01-284898 | 11/1989 |
| JP | 06-318094 | 11/1994 |
| JP | 07-319497 | 12/1995 |
| JP | 08-087297 | 4/1996 |
| JP | 09-081174 | 3/1997 |
| JP | 09-230893 | 9/1997 |
| JP | 09-319391 | 12/1997 |
| JP | 09-319394 | 12/1997 |
| JP | 11-249676 | 9/1999 |
| JP | 11-249679 | 9/1999 |
| JP | 2001-188777 | 7/2001 |
| JP | 2003-005774 | 1/2003 |

OTHER PUBLICATIONS

Supplementary European Search Report (Application No. 04735990.6) Dated Apr. 24, 2008.

Luciano Nebbia et al., "A Specialised Speech Synthesis Technique for Application to Automatic Reverse Directory Service," Interactive Voice Technology for Telecommunications Applications, 1998 IEEE 4th Workshop Torino, Italy, Sep. 29-30, 1998, pp. 223-228.

Marian Macchi, "Issues in Text-To-Speech Synthesis," Intelligence and Systems, IEEE International Joint Symposia in Rockville, MD, May 21-23, 1998, pp. 318-325.

Official Action (Application No. 2004-142907) Dated Jun. 30, 2008.

International Search Report of Sep. 7, 2004 for PCT/JP2004/008087.

* cited by examiner

SPEECH SYNTHESIS FOR SYNTHESIZING MISSING PARTS

TECHNICAL FIELD

The present invention relates to a speech synthesis device, a speech synthesis method and a program.

BACKGROUND ART

Techniques for synthesizing speech include a technique known as a recorded speech editing method. The recorded speech editing method is used in speech guidance systems at train stations and vehicle-mounted navigation devices and the like.

The recorded speech editing method associates a word with speech data representing speech in which the word is read out aloud, and after separating the sentence that is the object of speech synthesis into words, the method acquires speech data that was associated with the relevant words and joins the data (for example, see Japanese Patent Application Laid-Open No. H10-49193).

DISCLOSURE OF THE INVENTION

However, when speech data is simply joined together, the synthetic speech sounds unnatural for reasons including the fact that the pitch component frequency of the speech usually changes discontinuously at the boundaries between the pieces of data.

To solve this problem, a method can be considered in which a plurality of speech data are prepared that represent speech in which the same phonemes are read out aloud in respectively different cadences, and the cadence of the sentence that is the object of speech synthesis is also predicted. The speech data that matches the predicted result can then be selected and joined together.

However, when attempting to prepare speech data for each phoneme to produce natural synthetic speech by a recorded speech editing method, a vast amount of storage capacity is required for a storage device storing the speech data. Further, the amount of data that is the object of retrieval is also vast.

The present invention was made in view of the above described circumstances, and an object of this invention is to provide a simply configured speech synthesis device, speech synthesis method and program for producing natural synthetic speech at high speed.

In order to achieve the above object, a speech synthesis device according to the first aspect of this invention is characterized in that the device comprises:

voice unit storage means that stores a plurality of voice unit data representing a voice unit;

selection means that inputs sentence information representing a sentence and selects voice unit data whose reading is common with a speech sound comprising the sentence from the respective voice unit data;

missing part synthesis means that, for a speech sound among the speech sounds comprising the sentence for which the selection means could not select voice unit data, synthesizes speech data representing a waveform of the speech sound; and synthesis means that generates data representing synthetic speech by combining voice unit data that was selected by the selection means and speech data that was synthesized by the missing part synthesis means.

Further, a speech synthesis device according to the second aspect of this invention is characterized in that the device comprises:

voice unit storage means that stores a plurality of voice unit data representing a voice unit;

cadence prediction means that inputs sentence information representing a sentence and predicts the cadence of a speech sound comprising the sentence;

selection means that selects, from the respective voice unit data, voice unit data whose reading is common with a speech sound comprising the sentence and whose cadence matches a cadence prediction result under predetermined conditions;

missing part synthesis means that, for a speech sound among the speech sounds comprising the sentence for which the selection means could not select voice unit data, synthesizes speech data representing a waveform of the voice unit; and synthesis means that generates data representing synthetic speech by combining voice unit data that was selected by the selection means and speech data that was synthesized by the missing part synthesis means.

The selection means may be means that excludes from the objects of selection voice unit data whose cadence does not match a cadence prediction result under the predetermined conditions.

The missing part synthesis means may also comprise:

storage means that stores a plurality of data representing a phoneme or a phoneme fragment that comprises a phoneme; and synthesis means that, by identifying phonemes included in the speech sound for which the selection means could not select voice unit data and acquiring from the storage means data representing the identified phonemes or phoneme fragments that comprise the phonemes and combining these together, synthesizes speech data representing the waveform of the speech sound.

The missing part synthesis means may comprise missing part cadence prediction means that predicts the cadence of the speech sound for which the selection means could not select voice unit data; and the synthesis means may be means that identifies phonemes included in the speech sound for which the selection means could not select voice unit data and acquires from the storage means data representing the identified phonemes or phoneme fragments that comprise the phonemes, converts the acquired data such that the phonemes or phoneme fragments represented by the data match the cadence result predicted by the missing part cadence prediction means, and combines together the converted data to synthesize speech data representing the waveform of the speech sound.

The missing part synthesis means may be means that, for a speech sound for which the selection means could not select voice unit data, synthesizes speech data representing the waveform of the voice unit in question based on the cadence predicted by the cadence prediction means.

The voice unit storage means may associate cadence data representing time variations in the pitch of a voice unit represented by voice unit data with the voice unit data in question and store the data; and the selection means may be means that selects, from the respective voice unit data, voice unit data whose reading is common with a speech sound comprising the sentence and for which a time variation in the pitch represented by the associated cadence data is closest to the cadence prediction result.

The speech synthesis device may further comprise utterance speed conversion means that acquires utterance speed data specifying conditions for a speed for producing the synthetic speech and selects or converts speech data and/or voice unit data comprising data representing the synthetic speech such that the speech data and/or voice unit data represents speech that is produced at a speed fulfilling the conditions specified by the utterance speed data.

The utterance speed conversion means may be means that, by eliminating segments representing phoneme fragments from speech data and/or voice unit data comprising data representing the synthetic speech or adding segments representing phoneme fragments to the voice unit data and/or speech data, converts the voice unit data and/or speech data such that the data represents speech that is produced at a speed fulfilling the conditions specified by the utterance speed data.

The voice unit storage means may associate phonetic data representing the reading of voice unit data with the voice unit data and store the data; and the selection means may be means that handles voice unit data with which is associated phonetic data representing a reading that matches the reading of a speech sound comprising the sentence as voice unit data whose reading is common with the speech sound.

Further, a speech synthesis method according to the third aspect of this invention is characterized in that the method comprises the steps of:

storing a plurality of voice unit data representing a voice unit;

inputting sentence information representing a sentence;

selecting voice unit data whose reading is common with a speech sound comprising the sentence from the respective voice unit data;

synthesizing speech data representing the waveform of a speech sound among the speech sounds comprising the sentence for which voice unit data could not be selected; and generating data representing synthetic speech by combining the selected voice unit data and the synthesized speech data.

Furthermore, a speech synthesis method according to the fourth aspect of this invention is characterized in that the method comprises the steps of:

storing a plurality of voice unit data representing a voice unit;

inputting sentence information representing a sentence and predicting the cadence of speech sounds comprising the sentence;

selecting from the respective voice unit data, voice unit data whose reading is common with a speech sound comprising the sentence and whose cadence matches a cadence prediction result under predetermined conditions;

synthesizing speech data representing the waveform of a speech sound among the speech sounds comprising the sentence for which voice unit data could not be selected; and generating data representing synthetic speech by combining the selected voice unit data and the synthesized speech data.

Further, a program according to the fifth aspect of this invention is characterized in that the program is means for causing a computer to function as:

voice unit storage means that stores a plurality of voice unit data representing a voice unit;

selection means that inputs sentence information representing a sentence and selects voice unit data whose reading is common with a speech sound comprising the sentence from the respective voice unit data;

missing part synthesis means that, for a speech sound among the speech sounds comprising the sentence for which the selection means could not select voice unit data, synthesizes speech data representing a waveform of the speech sound; and synthesis means that generates data representing synthetic speech by combining the voice unit data that was selected by the selection means and the speech data that was synthesized by the missing part synthesis means.

Furthermore, a program according to the sixth aspect of this invention is characterized in that the program is means for causing a computer to function as:

voice unit storage means that stores a plurality of voice unit data representing a voice unit;

cadence prediction means that inputs sentence information representing a sentence and predicts the cadence of a speech sound comprising the sentence;

selection means that selects, from the respective voice unit data, voice unit data whose reading is common with a speech sound comprising the sentence and whose cadence matches a cadence prediction result under predetermined conditions;

missing part synthesis means that, for a speech sound among the speech sounds comprising the sentence for which the selection means could not select voice unit data, synthesizes speech data representing a waveform of the speech sound; and synthesis means that generates data representing synthetic speech by combining the voice unit data that was selected by the selection means and the speech data that was synthesized by the missing part synthesis means.

In order to achieve the above described object, a speech synthesis device according to the seventh aspect of this invention is characterized in that the device comprises:

voice unit storage means that stores a plurality of voice unit data representing a voice unit;

cadence prediction means that inputs sentence information representing a sentence and predicts the cadence of a speech sound comprising the sentence;

selection means that selects, from the respective voice unit data, voice unit data whose reading is common with a speech sound comprising the sentence and whose cadence is closest to a cadence prediction result; and synthesis means that generates data representing synthetic speech by combining together the voice unit data that were selected.

The selection means may be means that excludes from the objects of selection voice unit data whose cadence does not match a cadence prediction result under predetermined conditions.

The speech synthesis device may further comprise utterance speed conversion means that acquires utterance speed data specifying speed conditions for producing the synthetic speech, and selects or converts speech data and/or voice unit data comprising data representing the synthetic speech such that the speech data and/or voice unit data represents speech that is produced at a speed fulfilling the conditions specified by the utterance speed data.

The utterance speed conversion means may be means that, by eliminating segments representing phoneme fragments from speech data and/or voice unit data comprising data representing the synthetic speech or adding segments representing phoneme fragments to the voice unit data and/or speech data, converts the voice unit data and/or speech data such that the voice unit data and/or speech data represents speech that is produced at a speed fulfilling the conditions specified by the utterance speed data.

The voice unit storage means may associate cadence data representing time variations in the pitch of a voice unit represented by voice unit data with the voice unit data in question and store the data; and the selection means may be means that selects from the respective voice unit data the voice unit data whose reading is common with a speech sound comprising the sentence and for which time variations in a pitch represented by the associated cadence data are closest to the cadence prediction result.

The voice unit storage means may associate phonetic data representing the reading of voice unit data with the voice unit data in question and store the data; and the selection means may be means that handles voice unit data with which is associated phonetic data representing a reading that matches the reading of a speech sound comprising the sentence as voice unit data whose reading is common with the speech sound.

Further, a speech synthesis method according to the eighth aspect of this invention is characterized in that the method comprises the steps of:

storing a plurality of voice unit data representing a voice unit;

inputting sentence information representing a sentence and predicting the cadence of speech sounds comprising the sentence;

selecting from the respective voice unit data, voice unit data whose reading is common with a speech sound comprising the sentence and whose cadence is closest to the cadence prediction result; and generating data representing synthetic speech by combining together the voice unit data that were selected.

Further, a program according to the ninth aspect of this invention is characterized in that the program is means for causing a computer to function as:

voice unit storage means that stores a plurality of voice unit data representing a voice unit;

cadence prediction means that inputs sentence information representing a sentence and predicts the cadence of speech sounds comprising the sentence;

selection means that selects, from the respective voice unit data, voice unit data whose reading is common with a speech sound comprising the sentence and whose cadence is closest to the cadence prediction result; and synthesis means that generates data representing synthetic speech by combining together the voice unit data that were selected.

As described in the foregoing, according to this invention a simply configured speech synthesis device, speech synthesis method and program for producing natural synthetic speech at high speed are realized.

BEST MODES FOR CARRYING OUT THE INVENTION

Figure 1:
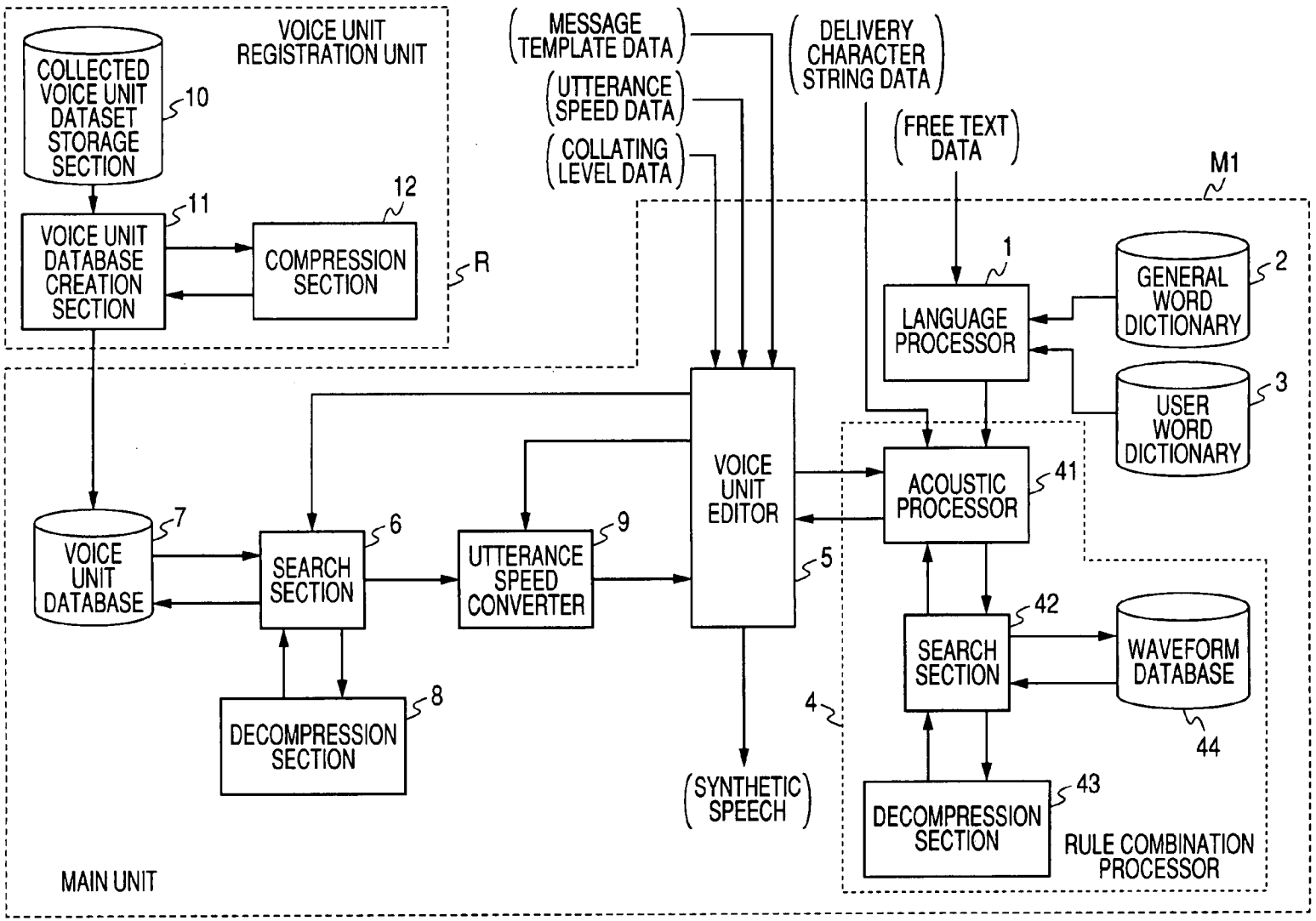
FIG. 1 is a block diagram showing the configuration of a speech synthesis system according to the first embodiment of this invention.

Hereunder, embodiments of this invention are described referring to the drawings.

First Embodiment

FIG. 1 is a diagram showing the configuration of a speech synthesis system according to the first embodiment of this invention. As shown in the figure, this speech synthesis system comprises a main unit M1 and a voice unit registration unit R.

The main unit M1 is composed by a language processor 1, a general word dictionary 2, a user word dictionary 3, a rule combination processor 4, a voice unit editor 5, a search section 6, a voice unit database 7, a decompression section 8 and a utterance speed converter 9. Of these, the rule combination processor 4 comprises an acoustic processor 41, a search section 42, a decompression section 43 and a waveform database 44.

The language processor 1, acoustic processor 41, search section 42, decompression section 43, voice unit editor 5, search section 6, decompression section 8 and utterance speed converter 9 each comprise a processor such as a CPU (Central Processing Unit) or DSP (Digital Signal Processor) and a memory that stores programs to be executed by the processor. They respectively perform processing that is described later.

In this connection, a configuration may be adopted in which one part or all of the functions of the language processor 1, the acoustic processor 41, the search section 42, the decompression section 43, the voice unit editor 5, the search section 6, the decompression section 8 and the utterance speed converter 9 are performed by a single processor. Accordingly, for example, a processor that performs the function of the decompression section 43 may also perform the function of the decompression section 8, and a single processor may simultaneously perform the functions of the acoustic processor 41, the search section 42 and the decompression section 43.

The general word dictionary 2 is composed by a non-volatile memory such as a PROM (Programmable Read Only Memory) or a hard-disk device. In the general word dictionary 2, words that include ideograms (for example, Chinese characters) and the like, and phonograms (for example, kana (Japanese syllabary) and phonetic symbols) that represent the reading of the words and the like are stored after being previously associated with each other by the manufacturer of this speech synthesis system or the like.

The user word dictionary 3 is composed by a rewritable non-volatile memory such as an EEPROM (Electrically Erasable/Programmable Read Only Memory) or hard disk device and a control circuit that controls writing of data to the non-volatile memory. In this connection, a processor may perform the functions of this control circuit or a configuration may be employed in which a processor that performs a part or all of the functions of the language processor 1, the acoustic processor 41, the search section 42, the decompression section 43, the voice unit editor 5, the search section 6, the decompression section 8 and the utterance speed converter 9 also performs the function of the control circuit of the user word dictionary 3.

In accordance with an operation by a user, the user word dictionary 3 can acquire from outside words including ideograms and the like as well as phonograms representing the reading of the words and the like, and can associate these with each other and store the resulting data. It is sufficient that the user word dictionary 3 stores words and the like that are not stored in the general word dictionary 2 as well as phonograms that represent the readings of these words.

The waveform database 44 comprises a non-volatile memory such as a PROM or a hard disk device. In the waveform database 44, phonograms and compressed waveform data obtained by entropy coding of waveform data representing the waveforms of speech units represented by the phonograms are stored after being previously associated with each other by the manufacturer of this speech synthesis system or the like. The speech units are short speech sounds of an extent that can be used in a method according to a synthesis by rule system, and more specifically are speech sounds that are separated into phonemes or units such as VCV (Vowel-Consonant-Vowel) syllables. In this connection, the waveform data prior to entropy coding may comprise, for example, digital format data that was subjected to PCM (Pulse Code Modulation).

The voice unit database 7 is composed by a non-volatile memory such as a PROM or a hard disk device.

Figure 2:
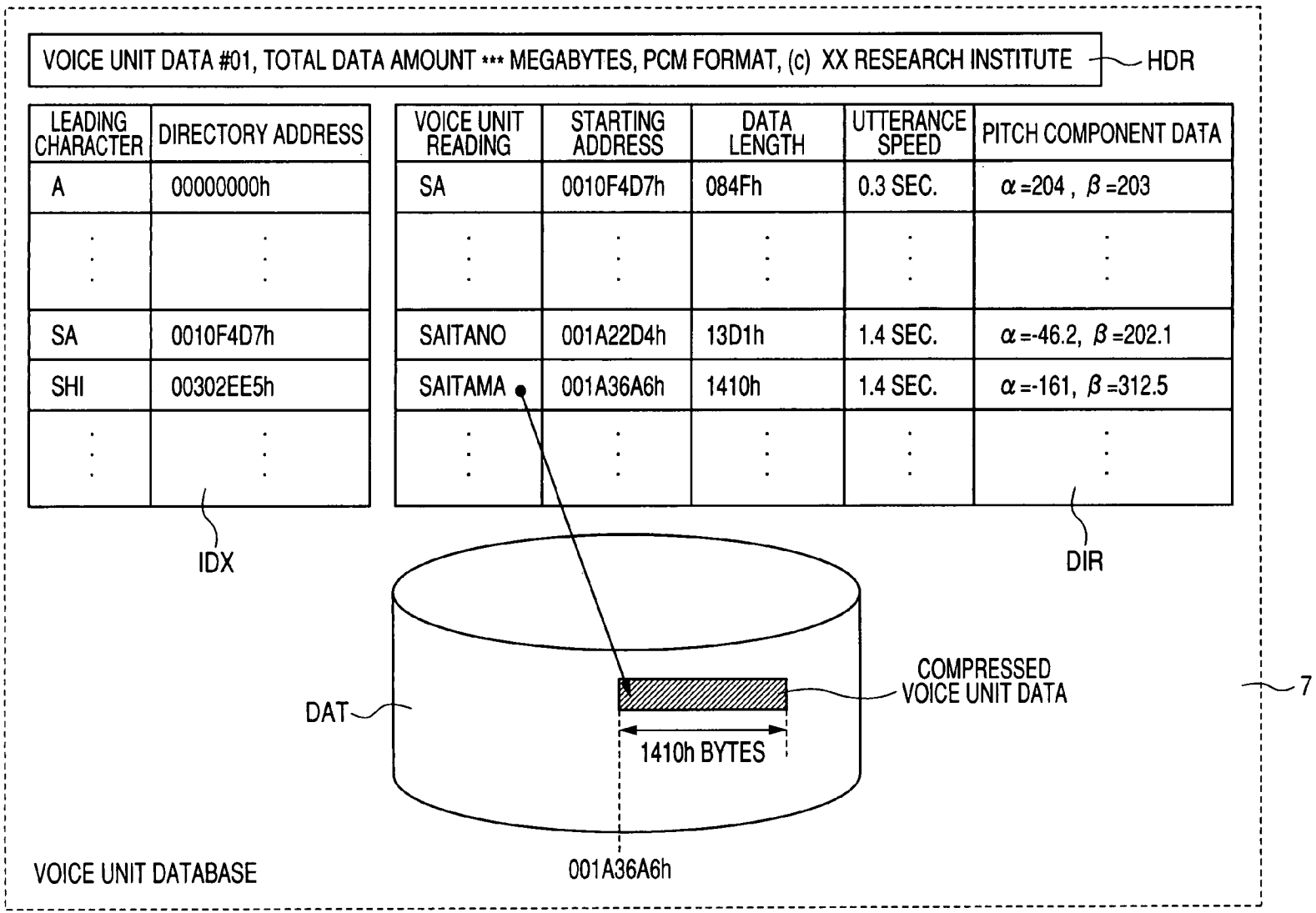
FIG. 2 is a view that schematically shows the data structure of the voice unit database.

The voice unit database 7, for example, stores data having the data structure shown in FIG. 2. More specifically, as shown in the figure, data stored in the voice unit database 7 is divided into four parts consisting of a header part HDR, an index part IDX, a directory part DIR and a data part DAT.

Storage of data in the voice unit database 7 is, for example, previously performed by a manufacturer of the speech synthesis system and/or is performed by the voice unit registration unit R conducting an operation that is described later.

In the header part HDR is stored data for identification in the voice unit database 7, and data showing the data amount, data format and attributes such as copyright and the like of data in the index part IDX, the directory part DIR and the data part DAT.

In the data part DAT is stored compressed voice unit data obtained by conducting entropy coding of voice unit data that represents the waveforms of voice units.

In this connection, the term "voice unit" refers to one segment that includes one or more consecutive phonemes of speech, and normally comprises a segment for a single word or a plurality of words. In some cases a voice unit may include a conjunction.

Further, voice unit data prior to entropy coding may comprise data of the same format (for example, digital format data that underwent PCM) as the above described waveform data prior to entropy coding for generating compressed waveform data.

In the directory part DIR, for the respective compressed speech data, the following data are stored in a form in which they are associated with each other:

(A) data representing phonograms indicating the reading of a voice unit represented by the compressed voice unit data (voice unit reading data);

(B) data representing the starting address of the storage location in which the compressed voice unit data is stored;

(C) data representing the data length of the compressed voice unit data;

(D) data representing the utterance speed (duration when played back) of a voice unit represented by the compressed voice unit data (speed initial value data); and (E) data representing time variations in the frequency of a pitch component of the voice unit (pitch component data).

(It is assumed that addresses are assigned to storage areas of the voice unit database 7).

In this connection, FIG. 2 illustrates a case in which, as data included in the data part DAT, compressed voice unit data with a data amount of 1410 h bytes that represents the waveform of a voice unit for which the reading is "saitama" is stored in a logical location starting with the address 001A36A6h. (In the present specification and drawings, numbers with the character "h" attached to the end represent hexadecimal values.)

Among the above described set of data (A) to (E), the data of at least (A) (i.e. the voice unit reading data) is stored in a storage area of the voice unit database 7 in a state in which it was sorted according to an order that was decided on the basis of the phonograms represented by the voice unit reading data (for example, when the phonograms are Japanese kana, in a state in which they are arranged in descending order of addresses in accordance with the order of the Japanese syllabary).

Further, for example, as shown in the figure, in a case in which the pitch component frequency of a voice unit is closely analogous to the primary function of elapsed time from the start of the voice unit, the above described pitch component data may comprise data showing the value of a gradient $\alpha$ and a segment $\beta$ of the primary function. (The unit of the gradient $\alpha$ may be, for example, "hertz/second", and the unit of the segment $\beta$ may be, for example, "hertz".)

Further, it is assumed that the pitch component data also includes data (not shown) that represents whether or not a voice unit represented by the compressed voice unit data was nasalized and whether or not it was devocalized.

In the index part IDX is stored data for identifying the approximate logical location of data in the directory part DIR on the basis of the voice unit reading data. More specifically, for example, assuming that the voice unit reading data represents Japanese kana, a kana character and data (directory address) showing which address range contains voice unit reading data in which the first character is this kana character are stored in a condition in which they are associated with each other.

In this connection, a configuration may be adopted in which a single non-volatile memory performs a part or all of the functions of the general word dictionary 2, the user word dictionary 3, the waveform database 4 and the voice unit database 7.

As shown in FIG. 1, the voice unit registration unit R comprises a collected voice unit dataset storage section 10, a voice unit database creation section 11 and a compression section 12. The voice unit registration unit R may be connected to the voice unit database 7 in a detachable condition, and in this case, except when newly writing data to the voice unit database 7, the main unit M1 may be caused to perform the operations described later in a state in which the voice unit registration unit R is detached from the main unit M1.

The collected voice unit dataset storage section 10 comprises a rewritable non-volatile memory such as a hard disk device.

In the collected voice unit dataset storage section 10, phonograms representing the readings of voice units and voice unit data representing waveforms obtained by collecting the sounds produced when a person actually vocalized the voice units are stored in a condition in which they were previously associated with each other by the manufacturer of the speech synthesis system or the like. In this connection, the voice unit data, for example, may comprise digital format data that was subjected to pulse-code modulation (PCM).

The voice unit database creation section 11 and the compression section 12 comprise a processor such as a CPU and a memory that stores programs to be executed by the processor and the like, and conduct the processing described later in accordance with the programs.

A configuration may be adopted in which a single processor performs a part or all of the functions of the voice unit database creation section 11 and the compression section 12, or in which a processor that performs a part or all of the functions of the language processor 1, the acoustic processor 41, the search section 42, the decompression section 43, the voice unit editor 5, the search section 6, the decompression section 8 and the utterance speed converter 9 also performs the functions of the voice unit database creation section 11 and the compression section 12. Further, a processor performing the functions of the voice unit database creation section 11 or the compression section 12 may also perform the function of a control circuit of the collected voice unit dataset storage section 10.

The voice unit database creation section 11 reads out from the collected voice unit dataset storage section 10 phonograms and voice unit data that were associated with each other, and identifies time variations in the pitch component frequency of speech represented by the voice unit data as well as the utterance speed.

Identification of the utterance speed may be performed, for example, by counting the number of samples of the voice unit data.

Time variations in the pitch component frequency may be identified, for example, by performing cepstrum analysis on the voice unit data. More specifically, for example, the time variations can be identified by separating the waveform represented by the voice unit data into a number of fragments on a time axis, converting the intensity of the respective fragments that were acquired to values that are substantially equivalent to a logarithm of the original values (the base of the logarithm is arbitrary), and determining the spectrum (i.e. cepstrum) of the fragments whose values were converted by use of a fast Fourier transformation method (or by another arbitrary method that generates data representing results obtained by subjecting discrete variables to Fourier transformation). The minimum value among the frequencies that impart the maximum value for this cepstrum is then identified as the pitch component frequency in the fragment.

In this connection, for example, a satisfactory result can be anticipated by converting voice unit data into pitch waveform data according to a technique described in Japanese Patent Laid-Open No. 2003-108172, and then identifying time variations in the pitch component frequency based on the pitch waveform data. More specifically, voice unit data may be converted into a pitch waveform signal by extracting a pitch signal by filtering the voice unit data, dividing the waveform represented by the voice unit data into segments of a unit pitch length based on the extracted pitch signal, and identifying, for each segment, the phase shift based on the correlation with the pitch signal to align the phases of the respective segments. The time variations in the pitch component frequency may then be identified by handling the obtained pitch waveform signals as voice unit data by performing cepstrum analysis or the like.

The voice unit database creation section 11 supplies voice unit data that was read out from the collected voice unit dataset storage section 10 to the compression section 12.

The compression section 12 subjects voice unit data supplied by the voice unit database creation section 11 to entropy coding to create compressed voice unit data and returns this data to the voice unit database creation section 11.

When the voice unit database creation section 11 receives from the compression section 12 the compressed voice unit data that was created after identifying the utterance speed and time variations in the pitch component frequency of voice unit data and then subjecting the voice unit data to entropy coding, the voice unit database creation section 11 writes this compressed voice unit data into a storage area of the voice unit database 7 as data comprising the data part DAT.

Further, a phonogram that was read out from the collected voice unit dataset storage section 10 as an item showing the reading of a voice unit represented by the written compressed voice unit data is written by the voice unit database creation section 11 in a storage area of the voice unit database 7 as voice unit reading data.

The starting address of the written compressed voice unit data within the storage area of the voice unit database 7 is also identified and this address written in a storage area of the voice unit database 7 as data of the above described (B).

Further, the data length of this compressed voice unit data is identified and the identified data length is written in a storage area of the voice unit database 7 as data of the above (C).

Furthermore, data showing the result obtained after identifying time variations in the pitch component frequency and the utterance speed of a voice unit represented by the compressed voice unit data is created, and this data is written in a storage area of the voice unit database 7 as speed initial value data and pitch component data.

Next, the operation of this speech synthesis system is described.

First, a description is given that assumes that the language-processor 1 acquired from outside free text data that describes a sentence (free text) including ideograms that was prepared by a user as an object for speech synthesis by the speech synthesis system.

In this connection, a method by which the language processor 1 acquires free text data is arbitrary and, for example, the language processor 1 may acquire the data from an external device or network through an interface circuit that is not shown in the figure, or may read the data from a recording medium (for example, a floppy (registered trademark) disk or CD-ROM) that was placed in a recording medium drive device (not shown), through the recording medium drive device.

Further, a configuration may be adopted in which a processor performing the functions of the language processor 1 delivers text data used for other processing which it executes to the processing of the language processor 1 as free text data.

Examples of the other processing which the processor executes include processing that causes a processor to perform functions of an agent device that identifies and executes processing that should be performed in order to fulfill a request that was identified by acquiring speech data representing speech and performing speech recognition processing on the speech data to identify words represented by the speech, and based on the identified words, identifying the contents of a request of the speaker of the speech.

When the language processor 1 acquires free text data, it identifies the respective ideograms included in the free text by retrieving phonograms representing the readings thereof from the general word dictionary 2 or the user word dictionary 3. It then replaces the ideograms with the identified phonograms. The language processor 1 then supplies a phonogram string obtained as a result of replacing all the ideograms in the free text with phonograms to the acoustic processor 41.

When the acoustic processor 41 is supplied with the phonogram string from the language processor 1, for each of the phonograms included in the phonogram string, it instructs the search section 42 to search for the waveforms of speech unit represented by the respective phonograms.

The search section 42 searches the waveform database 44 in response to this instruction and retrieves compressed waveform data representing the waveforms of the speech units represented by the respective phonograms included in the phonogram string. It then supplies the retrieved compressed waveform data to the decompression section 43.

The decompression section 43 decompresses the compressed waveform data that was supplied by the search section 42 to restore the waveform data to the same condition as prior to compression and returns this data to the search section 42. The search section 42 supplies the waveform data that was returned from the decompression section 43 to the acoustic processor 41 as the search result.

The acoustic processor 41 supplies the waveform data that was supplied from the search section 42 to the voice unit editor 5 in an order that is in accordance with the sequence of each phonogram in the phonogram string that was supplied by the language processor 1.

When the waveform data is supplied by the acoustic processor 41, the voice unit editor 5 joins the waveform data together in the order in which it was supplied and outputs it as data representing synthetic speech (synthetic speech data). This synthetic speech that was synthesized on the basis of free text data corresponds to speech that was synthesized by a technique according to a synthesis by rule system.

In this connection, the method by which the voice unit editor 5 outputs the synthetic speech data is arbitrary and, for example, a configuration may be adopted in which synthetic speech represented by the synthetic speech data is played back through a D/A (Digital-to-Analog) converter or speaker (not shown in the figure). Further, the synthetic speech data may be sent to an external device or network through an interface circuit (not shown) or may be written on a recording medium that was set in a recording medium drive device (not shown) by use of the recording medium drive device. A configuration may also be adopted in which a processor performing the functions of the voice unit editor 5 delivers the synthetic speech data to another processing which it executes.

Next, it is assumed that the acoustic processor 41 acquired data representing a phonogram string, that was delivered from outside (delivery character string data). (In this connection, a method by which the acoustic processor 41 acquires delivery character string data is also arbitrary and, for example, the acoustic processor 41 may acquire the delivery character string data by a similar method as the method by which the language processor 1 acquires free text data.)

In this case, the acoustic processor 41 handles a phonogram string represented by the delivery character string data in the same manner as a phonogram string supplied by the language processor 1. As a result, compressed waveform data corresponding to phonograms included in the phonogram string represented by the delivery character string data is retrieved by the search section 42, and is decompressed by the decompression section 43 to restore the waveform data to the same condition as prior to compression. The respective waveform data that was decompressed is supplied to the voice unit editor 5 through the acoustic processor 41. The voice unit editor 5 joins this waveform data together in an order in accordance with the sequence of the respective phonograms in the phonogram string represented by the delivery character string data, and outputs the data as synthetic speech data. This synthetic speech data that was synthesized based on the delivery character string data also represents speech that was synthesized by a technique according to a synthesis by rule system.

Next, it is assumed that the voice unit editor 5 acquired message template data, utterance speed data and collating level data.

In this connection, message template data is data that represents a message template as a phonogram string, and utterance speed data is data that shows a specified value (specified value for the length of time to vocalize the message template) of the utterance speed of the message template represented by the message template data. The collating level data is data that specifies search conditions for search processing described later that is performed by the search section 6, and hereunder it is assumed that it takes a value of either "1", "2" or "3", with "3" indicating the most stringent search conditions.

The method by which the voice unit editor 5 acquires message template data, utterance speed data or collating level data is arbitrary and, for example, the voice unit editor 5 may acquire message template data, utterance speed data or collating level data by the same method as the language processor 1 acquires free text data.

When message template data, utterance speed data and collating level data are supplied to the voice unit editor 5, the voice unit editor 5 instructs the search section 6 to retrieve all the compressed voice unit data with which are associated phonograms that match phonograms representing the reading of voice units included in the message template.

The search section 6 searches the voice unit database 7 in response to the instruction of the voice unit editor 5 to retrieve the corresponding compressed voice unit data and the above-described voice unit reading data, speed initial value data and pitch component data that are associated with the compressed voice unit data. The search section 6 then supplies the retrieved compressed waveform data to the decompression section 8. When a plurality of compressed voice unit data correspond to a common phonogram or phonogram string, all of the compressed voice unit data in question are retrieved as candidates for data to be used in the speech synthesis. In contrast, when a voice unit exists for which compressed voice unit data could not be retrieved, the search section 6 generates data that identifies the voice unit in question (hereunder, referred to as "missing part identification data").

The decompression section 8 decompresses the compressed voice unit data that was supplied by the search section 6 to restore the voice unit data to the same condition as prior to compression, and returns this data to the search section 6. The search section 6 supplies the voice unit data that was returned by the decompression section 8 and the retrieved voice unit reading data, speed initial value data and pitch component data to the utterance speed converter 9 as the search result. When the search section 6 generated missing part identification data, it also supplies the missing part identification data to the utterance speed converter 9.

The voice unit editor 5 instructs the utterance speed converter 9 to convert the voice unit data that was supplied to the utterance speed converter 9 such that the duration of the voice unit represented by the voice unit data matches the speed indicated by the utterance speed data.

In response to the instruction of the voice unit editor 5, the utterance speed converter 9 converts the voice unit data supplied by the search section 6 such that it conforms with the instruction, and supplies this data to the voice unit editor 5. More specifically, for example, after identifying the original duration of the voice unit data supplied by the search section 6 based on the speed initial value data that was retrieved, the utterance speed converter 9 may resample this voice unit data and convert the number of samples of the voice unit data to obtain a duration that matches the speed designated by the voice unit editor 5.

The utterance speed converter 9 also supplies pitch component data and voice unit reading data that was supplied by the search section 6 to the voice unit editor 5, and when missing part identification data was supplied by the search section 6 it also supplies this missing part identification data to the voice unit editor 5.

In this connection, when utterance speed data is not supplied to the voice unit editor 5, the voice unit editor 5 may instruct the utterance speed converter 9 to supply the voice unit data that was supplied to the utterance speed converter 9 to the voice unit editor 5 without converting the data, and in response to this instruction the utterance speed converter 9 may supply the voice unit data that was supplied from the search section 6 to the voice unit editor 5 in the condition in which it was received.

When the voice unit editor 5 receives the voice unit data, voice unit reading data and pitch component data from the utterance speed converter 9, for each voice unit the voice unit editor 5 selects, from the supplied voice unit data, one voice unit data that represents a waveform that can approach the waveform of a voice unit comprising the message template. In this case, the voice unit editor 5 makes the setting regarding which kind of conditions a waveform should fulfill to be selected as a waveform close to that of a voice unit of the message template in accordance with the acquired collating level data.

More specifically, first, the voice unit editor 5 predicts the cadence (accent, intonation, stress, duration of phoneme and the like) of the message template by performing analysis based on a cadence prediction method such as, for example, the "Fujisaki model" or "ToBI (Tone and Break Indices)" on the message template represented by the message template data.

Next, the voice unit editor 5, for example, carries out the following processing:

(1) When the value of the collating level data is "1", the voice unit editor 5 selects all of the voice unit data that was supplied by the utterance speed converter 9 (that is, voice unit data whose reading matches a voice unit in the message template) as items that are close to waveforms of voice units in the message template.

(2) When the value of the collating level data is "2", the voice unit editor 5 selects voice unit data as data that is close to the waveform of a voice unit in the message template only when the voice unit data in question fulfills the condition of (1) (i.e., condition that phonogram representing reading matches) and there is a strong correlation (for example, when a time difference for the position of an accent is less than a predetermined amount) that is equal to or greater than a predetermined amount between the contents of pitch component data representing time variations in the pitch component frequency of the voice unit data and a prediction result for the accent (so-called cadence) of a voice unit included in the message template. In this connection, a prediction result for the accent of a voice unit in a message template can be specified from the cadence prediction result for a message template and, for example, the voice unit editor 5 may interpret that the position at which the pitch component frequency is predicted to be at its highest is the predicted position for the accent. In contrast, for the position of an accent in a voice unit represented by the voice unit data, for example, the position at which the pitch component frequency is highest can be specified on the basis of the above described pitch component data and this position may be interpreted as being the accent position. Further, cadence prediction may be conducted for an entire sentence or may be conducted by dividing a sentence into predetermined units and performing the prediction for the respective units.

(3) When the value of the collating level data is "3", the voice unit editor 5 selects voice unit data as data that is close to the waveform of a voice unit in the message template only when the voice unit data in question fulfills the condition of (2) (i.e., condition that phonogram representing reading and accent match) and the presence or absence of nasalization or devocalization of speech represented by the voice unit data matches the cadence prediction result for the message template. The voice unit editor 5 may determine the presence or absence of nasalization or devocalization of speech represented by the voice unit data based on pitch component data that was supplied from the utterance speed converter 9.

When there is a plurality of voice unit data matching the conditions that the voice unit editor 5 set for a single voice unit, the voice unit editor 5 narrows down the plurality of voice unit data to just a single voice unit data in accordance with conditions that are more stringent that the set conditions.

More specifically, for example, when the set conditions correspond to collating level data value "1" and there is a plurality of voice unit data that fulfill the conditions, the voice unit editor 5 may perform operations to select voice unit data that also matches search conditions that correspond to collating level data value "2", and if a plurality of voice unit data are again selected the voice unit editor 5 may perform operations to select from the selection results voice unit data that also matches search conditions that correspond to collating level data value "3". When a plurality of voice unit data still remains after narrowing down the candidates by use of the search conditions corresponding to the collating level data value "3", the remaining candidates may be narrowed down to a single candidate by use of an arbitrary criterion.

When the voice unit editor 5 is also supplied with missing part identification data from the utterance speed converter 9, the voice unit editor 5 extracts from the message template data a phonogram string representing the reading of the voice unit indicated by the missing part identification data and supplies this phonogram string to the acoustic processor 41, and instructs the acoustic processor 41 to synthesize the waveform of this voice unit.

Upon receiving this instruction, the acoustic processor 41 handles the phonogram string supplied from the voice unit editor 5 in the same way as a phonogram string represented by delivery character string data. As a result, compressed waveform data representing waveforms of speech indicated by the phonograms included in the phonogram string are extracted by the search section 42, the compressed waveform data is decompressed by the decompression section 43 to restore the waveform data to its original condition, and this data is supplied to the acoustic processor 41 through the search section 42. The acoustic processor 41 then supplies this waveform data to the voice unit editor 5.

When the waveform data is sent by the acoustic processor 41, the voice unit editor 5 combines this waveform data and the voice unit data that was selected by the voice unit editor 5 from the voice unit data supplied by the utterance speed converter 9 in an order that is in accordance with the sequence of the phonogram string in the message template shown by the message template data, and outputs the thus-combined data as data representing synthetic speech.

In this connection, when missing part identification data is not included in the data supplied by the utterance speed converter 9, the voice unit editor 5 does not instruct the acoustic processor 41 to synthesize a waveform, and immediately combines the selected voice unit data together in an order in accordance with the sequence of the phonogram string in the message template shown by the message template data, and outputs the thus-combined data as data representing synthetic speech.

As described in the foregoing, according to the speech synthesis system of the first embodiment of this invention, voice unit data representing the waveforms of voice units that may be in units larger than a phoneme are naturally joined together by a recorded speech editing method based on a cadence prediction result, to thereby synthesize speech that reads aloud a message template. The storage capacity of the voice unit database 7 can be made smaller than in the case of storing a waveform for each phoneme, and searching can also be performed at a high speed. A small and lightweight configuration can thus be adopted for this speech synthesis system and high-speed processing can also be achieved.

In this connection, the configuration of this speech synthesis system is not limited to the configuration described above.

For example, the waveform data or voice unit data need not necessarily be PCM format data, and an arbitrary data format may be used.

Further, the waveform database 44 or voice unit database 7 need not necessarily store waveform data or voice unit data in a state in which the data is compressed. When the waveform database 44 or the voice unit database 7 stores waveform data or voice unit data in a state in which the data is not compressed, it is not necessary for the main unit M1 to comprise the decompression section 43.

The waveform database 44 need not necessarily store speech units in a form in which they are separated individually. For example, a configuration may be adopted in which the waveform of speech comprising a plurality of speech units is stored with data identifying the positions individual speech units occupy in the waveform. In this case, the voice unit database 7 may perform the function of the waveform database 44. More specifically, a series of speech data may be stored in sequence inside the waveform database 44 in the same format as the voice unit database 7, and in this case, in order to utilize the database as a waveform database, each phoneme in the speech data is stored in a condition in which it is associated with a phonogram or pitch information or the like.

The voice unit database creation section 11 may also read, through a recording medium drive device (not shown), voice unit data or a phonogram string as material of new compressed voice unit data to be added to the voice unit database 7 from a recording medium that was set in the recording medium drive device.

Further, the voice unit registration unit R need not necessarily comprise the collected voice unit dataset storage section 10.

Furthermore, the pitch component data may be data representing time variations in the pitch length of a voice unit represented by voice unit data. In this case, the voice unit editor 5 may identify a location at which the pitch length is shortest (i.e. the location where the frequency is highest) based on the pitch component data, and interpret that location as the location of the accent.

The voice unit editor 5 may also previously store cadence registration data that represents the cadence of a specific voice unit, and when this specific voice unit is included in a message template the voice unit editor 5 may handle the cadence represented by this cadence registration data as the cadence prediction result.

The voice unit editor 5 may also be configured to newly store a past cadence prediction result as cadence registration data.

Further, the voice unit database creation section 11 may also comprise a microphone, an amplifier, a sampling circuit, an A/D (Analog-to-Digital) converter and a PCM encoder and the like. In this case, instead of acquiring voice unit data from the collected voice unit dataset storage section 10, the voice unit database creation section 11 may create voice unit data by amplifying speech signals representing speech that was collected through its own microphone, performing sampling and A/D conversion, and then subjecting the sampled speech signals to PCM modulation.

The voice unit editor 5 may also be configured to supply waveform data that it received from the acoustic processor 41 to the utterance speed converter 9, such that the utterance speed converter 9 causes the duration of a waveform represented by the waveform data to match a speed shown by utterance speed data.

Further, the voice unit editor 5 may, for example, acquire free text data at the same time as the language processor 1 and select voice unit data that matches at least one part of speech (a phonogram string) included in the free text represented by the free text data by performing substantially the same processing as processing to select voice unit data of a message template, and use the selected voice unit data for speech synthesis.

In this case, with respect to the voice unit selected by the voice unit editor 5, the acoustic processor 41 need not cause the search section 42 to search for waveform data representing the waveform of this voice unit. In this connection, the voice unit editor 5 may notify the acoustic processor 41 of the voice unit that the acoustic processor 41 need not synthesize, and in response to this notification the acoustic processor 41 may cancel a search for the waveform of the speech unit comprising this voice unit.

Further, the voice unit editor 5 may, for example, acquire delivery character string data at the same time as the acoustic processor 41 and select voice unit data that represents a phonogram string included in a delivery character string represented by the delivery character string data by performing substantially the same processing as processing to select voice unit data of a message template, and use the selected voice unit data for speech synthesis. In this case, with respect to the voice unit represented by the voice unit data selected by the voice unit editor 5, the acoustic processor 41 need not cause the search section 42 to search for waveform data representing the waveform of this voice unit.

Second Embodiment

Figure 3:
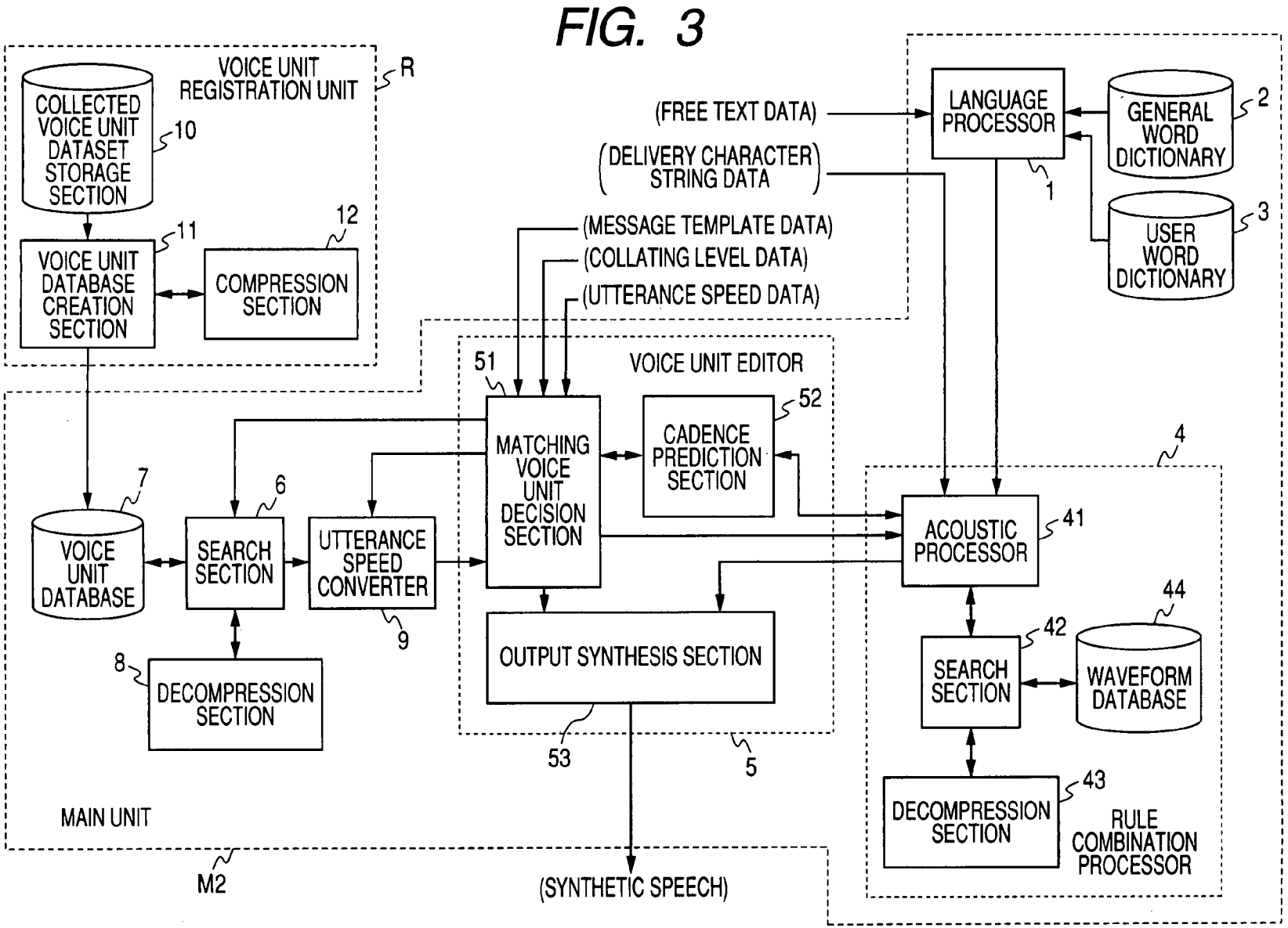
FIG. 3 is a block diagram showing the configuration of a speech synthesis system according to the second embodiment of this invention.

Next, the second embodiment of this invention is described. FIG. 3 is a view showing the configuration of a speech synthesis system of the second embodiment of this invention. As shown in the figure, similarly to first embodiment, this speech synthesis system comprises a main unit M2 and a voice unit registration unit R. Of these, the voice unit registration unit R has substantially the same configuration as the voice unit registration unit R of the first embodiment.

The main unit M2 comprises a language processor 1, a general word dictionary 2, a user word dictionary 3, a rule combination processor 4, a voice unit editor 5, a search section 6, a voice unit database 7, a decompression section 8 and a utterance speed converter 9. Of these, the language processor 1, the general word dictionary 2, the user word dictionary 3 and the voice unit database 7 have substantially the same configuration as in the first embodiment.

The language processor 1, voice unit editor 5, search section 6, decompression section 8 and utterance speed converter 9 each comprise a processor such as a CPU or a DSP and a memory that stores programs to be executed by the processor or the like. Each of these performs processing that is described later. In this connection, a configuration may be adopted in which a part or all of the functions of the language processor 1, the search section 42, the decompression section 43, the voice unit editor 5, the search section 6, and the utterance speed converter 9 are performed by a single processor.

Similarly to the device in the first embodiment, the rule combination processor 4 comprises an acoustic processor 41, a search section 42, a decompression section 43 and a waveform database 44. Of these, the acoustic processor 41, the search section 42 and the decompression section 43 each comprise a processor such as a CPU or a DSP and a memory that stores programs to be executed by the processor or the like, and they perform processing that is described later, respectively.

In this connection, a configuration may be adopted in which a part or all of the functions of the acoustic processor 41, the search section 42 and the decompression section 43 are performed by a single processor. Further, a configuration may be adopted in which a processor that performs a part or all of the functions of the language processor 1, the search section 42, the decompression section 43, the voice unit editor 5, the search section 6, the decompression section 8 and the utterance speed converter 9 also performs a part or all of the functions of the acoustic processor 41, the search section 42 and the decompression section 43. Accordingly, for example, a configuration may be adopted in which the decompression section 8 also performs the functions of the decompression section 43 of the rule combination processor 4.

The waveform database 44 comprises a non-volatile memory such as a PROM or a hard disk device. In the waveform database 44, phonograms and compressed waveform data obtained by entropy coding of phoneme fragment waveform data representing phoneme fragments that comprise phonemes (i.e. the speech of one cycle of a waveform of speech comprising a single phoneme (or the cycle amount of another predetermined number)) representing the phonograms are stored after being previously associated with each other by the manufacturer of this speech synthesis system or the like. In this connection, the phoneme fragment waveform data prior to entropy coding may comprise, for example, digital format data that was subjected to PCM.

The voice unit editor 5 comprises a matching voice unit decision section 51, a cadence prediction section 52 and an output synthesis section 53. The matching voice unit decision section 51, the cadence prediction section 52 and the output synthesis section 53 each comprise a processor such as a CPU or a DSP and a memory that stores programs to be executed by the processor or the like, and they perform processing that is described later, respectively.

A configuration may be adopted in which a part or all of the functions of the matching voice unit decision section 51, the cadence prediction section 52 and the output synthesis section 53 are performed by a single processor. Further, a configuration may be adopted in which a processor that performs a part or all of the functions of the language processor 1, the acoustic processor 41, the search section 42, the decompression section 43, the search section 42, the decompression section 43, the voice unit editor 5, the search section 6, the decompression section 8 and the utterance speed converter 9 also performs a part or all of the functions of the matching voice unit decision section 51, the cadence prediction section 52 and the output synthesis section 53. Accordingly, for example, a configuration may be adopted in which a processor that performs the functions of the output synthesis section 53 also performs the functions of the utterance speed converter 9.

Next, the operation of the speech synthesis system of FIG. 3 will be described.

First, it is assumed that the language processor 1 acquired from outside free text data that is substantially the same as that of the first embodiment. In this case, by performing substantially the same processing as in the first embodiment the language processor 1 replaces ideograms included in the free text data with phonograms. It then supplies a phonogram string obtained as a result of performing the replacement to the acoustic processor 41 of the rule combination processor 4.

When the acoustic processor 41 is supplied with the phonogram string from the language processor 1, for each of the phonograms included in the phonogram string it instructs the search section 42 to search for the waveform of a phoneme fragment comprising a phoneme represented by the phonogram in question. The acoustic processor 41 also supplies this phonogram string to the cadence prediction section 52 of the voice unit editor 5.

The search section 42 searches the waveform database 44 in response to this instruction and retrieves compressed waveform data that matches the contents of the instruction. It then supplies the retrieved compressed waveform data to the decompression section 43.

The decompression section 43 decompresses the compressed waveform data that was supplied by the search section 42 to restore the waveform data to the same condition as prior to compression and returns this data to the search section 42. The search section 42 supplies the phoneme fragment waveform data that was returned by the decompression section 43 to the acoustic processor 41 as the search result.

Meanwhile, the cadence prediction section 52 that was supplied with the phonogram string by the acoustic processor 41 generates cadence prediction data representing the cadence prediction result for the speech represented by the phonogram string by, for example, analyzing the phonogram string on the basis of a cadence prediction method similar to that performed by the voice unit editor 5 in the first embodiment. The cadence prediction section 52 then supplies the cadence prediction data to the acoustic processor 41.

When the acoustic processor 41 is supplied with phoneme fragment waveform data from the search section 42 and cadence prediction data from the cadence prediction section 52, it uses the supplied phoneme fragment waveform data to create speech waveform data that represents the waveforms of speech represented by the respective phonograms included in the phonogram string that was supplied by the language processor 1.

More specifically, the acoustic processor 41, for example, identifies the duration of phonemes comprised by phoneme fragments represented by the respective phoneme fragment waveform data that was supplied by the search section 42 based on the cadence prediction data that was supplied by the cadence prediction section 52. It may then generate speech waveform data by determining the closest integer to a value obtained by dividing the identified phoneme duration by the duration of the phoneme fragment represented by the relevant phoneme fragment waveform data and combining together the number of phoneme fragment waveform data that is equivalent to the determined integer.

In this connection, a configuration may be adopted in which the acoustic processor 41 not only determines the duration of speech represented by the speech waveform data based on the cadence prediction data, but also processes the phoneme fragment waveform data comprising the speech waveform data such that the speech represented by the speech waveform data has a strength or intonation or the like that matches the cadence indicated by the cadence prediction data.

Next, the acoustic processor 41 supplies the created speech waveform data to the output synthesis section 53 of the voice unit editor 5 in an order in accordance with the sequence of the respective phonograms in the phonogram string that was supplied from the language processor 1.

When the output synthesis section 53 receives the speech waveform data from the acoustic processor 41 it combines the speech waveform data together in the order in which the data was supplied by the acoustic processor 41, and outputs the resulting data as synthetic speech data. This synthetic speech that was synthesized on the basis of free text data corresponds to speech synthesized by a technique according to a synthesis by rule system.

In this connection, similarly to the voice unit editor 5 of the first embodiment, a method by which the output synthesis section 53 outputs synthetic speech data is arbitrary. Accordingly, for example, a configuration may be adopted in which synthetic speech represented by the synthetic speech data is played back through a D/A converter or a speaker (not shown in the figure). Further, the synthetic speech data may be sent to an external device or network through an interface circuit (not shown) or may be written, by use of a recording medium drive device (not shown), onto a recording medium that was set in the recording medium drive device. A configuration may also be adopted in which a processor performing the functions of the output synthesis section 53 delivers the synthetic speech data to another processing that it is executing.

Next, it is assumed that the acoustic processor 41 acquired delivery character string data that is substantially the same as that of the first embodiment. (In this connection, a method by which the acoustic processor 41 acquires delivery character string data is also arbitrary and, for example, the acoustic processor 41 may acquire the delivery character string data by a similar method as the method by which the language processor 1 acquires free text data.)

In this case, the acoustic processor 41 handles a phonogram string represented by the delivery character string data in the same manner as a phonogram string supplied by the language processor 1. As a result, compressed waveform data representing phoneme fragments that comprise phonemes represented by phonograms included in the phonogram string represented by the delivery character string data is retrieved by the search section 42, and is decompressed by the decompression section 43 to restore the phoneme fragment waveform data to the same condition as prior to compression. Meanwhile, the phonogram string represented by the delivery character string data is analyzed by the cadence prediction section 52 based on a cadence prediction method to thereby generate cadence prediction data representing the cadence prediction result for the speech represented by the phonogram string. The acoustic processor 41 then generates speech waveform data representing the waveform of speech represented by the respective phonograms included in the phonogram string represented by the delivery character string data, based on the respective phoneme fragment waveform data that was decompressed and the cadence prediction data. The output synthesis section 53 combines together the thus generated speech waveform data in an order in accordance with the sequence of the respective phonograms in the phonogram string represented by the delivery character string data and outputs the data as synthetic speech data. This synthetic speech data that was synthesized on the basis of delivery character string data also represents speech that was synthesized by a technique according to a synthesis by rule system.

Next, it is assumed that the matching voice unit decision section 51 of the voice unit editor 5 acquired message template data, utterance speed data and collating level data that are substantially the same as those described in the first embodiment. (In this connection, a method by which the matching voice unit decision section 51 acquires message template data, utterance speed data or collating level data is arbitrary and, for example, the matching voice unit decision section 51 may acquire message template data, utterance speed data or collating level data by the same method as the language processor 1 acquires free text data.)

When message template data, utterance speed data and collating level data are supplied to the matching voice unit decision section 51, the matching voice unit decision section 51 instructs the search section 6 to retrieve all compressed voice unit data which are associated with phonograms that match phonograms representing the reading of voice units included in the message template.

Similarly to the search section 6 of the first embodiment, the search section 6 searches the voice unit database 7 in response to the instruction of the matching voice unit decision section 51 to retrieve the corresponding compressed voice unit data and the above-described voice unit reading data, speed initial value data and pitch component data that are associated with the compressed voice unit data. The search section 6 then supplies the retrieved compressed waveform data to the decompression section 8. When a voice unit exists for which compressed voice unit data could not be retrieved, the search section 6 generates missing part identification data that identifies the voice unit in question.

The decompression section 8 decompresses the compressed voice unit data supplied by the search section 6 to restore the voice unit data to the same condition as prior to compression, and returns this data to the search section 6. The search section 6 supplies the voice unit data that was returned by the decompression section 8 and the retrieved voice unit reading data, speed initial value data and pitch component data to the utterance speed converter 9 as the search result. When the search section 6 generated missing part identification data, it also supplies the missing part identification data to the utterance speed converter 9.

The matching voice unit decision section 51 instructs the utterance speed converter 9 to convert the voice unit data that was supplied to the utterance speed converter 9 such that the duration of the voice unit represented by the voice unit data matches the speed indicated by the utterance speed data.

In response to the instruction of the matching voice unit decision section 51, the utterance speed converter 9 converts the voice unit data supplied by the search section 6 such that it matches the instruction, and supplies this data to the matching voice unit decision section 51. More specifically, for example, for respective segments obtained by separating the voice unit data supplied by the search section 6 into segments representing individual phonemes, after identifying parts representing phoneme fragments comprising phonemes represented by the segment based on the relevant segment, the number of samples of the entire voice unit data may be adjusted to obtain a duration that matches the speed that was designated by the matching voice unit decision section 51 by adjusting the length of segments by duplicating (one or a plurality of) the identified parts and inserting it into the relevant segment or by removing (one or a plurality of) the relevant parts from the segment. In this connection, the utterance speed converter 9 may, for each segment, decide the number of parts representing phoneme fragments to be inserted or removed such that the ratio of the duration does not substantially change among the phonemes represented by the respective segments. In this way, it is possible to perform more delicate adjustment of speech than a case in which phonemes are merely synthesized together.

Further, the utterance speed converter 9 also supplies pitch component data and voice unit reading data that was supplied by the search section 6 to the matching voice unit decision section 51, and when missing part identification data was supplied by the search section 6, the utterance speed converter 9 also supplies this missing part identification data to the matching voice unit decision section 51.

In this connection, when utterance speed data is not supplied to the matching voice unit decision section 51, the matching voice unit decision section 51 may instruct the utterance speed converter 9 to supply the voice unit data that was supplied to the utterance speed converter 9 to the matching voice unit decision section 51 without converting the data, and in response to this instruction the utterance speed converter 9 may supply the voice unit data that was supplied from the search section 6 to the matching voice unit decision section 51 in the condition in which it was received. In addition, when the number of samples of voice unit data that was supplied to the utterance speed converter 9 already matches a duration that matches the speed designated by the matching voice unit decision section 51, the utterance speed converter 9 may supply this voice unit data to the matching voice unit decision section 51 in the condition it was received without performing any conversion.

When the matching voice unit decision section 51 is supplied with voice unit data, voice unit reading data and pitch component data by the utterance speed converter 9, similarly to the voice unit editor 5 of the first embodiment, for each voice unit, the matching voice unit decision section 51 selects from among the voice unit data that was supplied, one voice unit data that represents a waveform that is close to the waveform of a voice unit comprising the message template, in accordance with conditions that correspond with the value of collating level data.

When a voice unit exists for which the matching voice unit decision section 51 could not select voice unit data that fulfills the conditions corresponding with the value of the collating level data from the voice unit data that was supplied by the utterance speed converter 9, the matching voice unit decision section 51 handles the voice unit in question in the same manner as a voice unit for which the search section 6 could not retrieve compressed voice unit data (i.e. a voice unit indicated by the above missing part identification data).

The matching voice unit decision section 51 then supplies the voice unit data that was selected as data that fulfills the conditions corresponding to the value of the collating level data to the output synthesis section 53.

Further, when missing part identification data was also supplied from the utterance speed converter 9 or when a voice unit exists for which voice unit data could not be selected that fulfills the conditions corresponding to the collating level data value, the matching voice unit decision section 51 extracts from the message template data a phonogram string representing the reading of the voice unit indicated by the missing part identification data (including a voice unit for which voice unit data could not be selected that fulfilled the conditions corresponding to the collating level data value) and supplies the phonogram string to the acoustic processor 41, and instructs the acoustic processor 41 to synthesize the waveform of this voice unit.

Upon receiving this instruction, the acoustic processor 41 handles the phonogram string supplied from the matching voice unit decision section 51 in the same manner as a phonogram string represented by delivery character string data. As a result, compressed waveform data representing phoneme fragments comprising phonemes represented by phonograms included in the phonogram string are retrieved by the search section 42, and the compressed waveform data is decompressed by the decompression section 43 to obtain the phoneme fragment waveform data prior to compression. Meanwhile, cadence prediction data representing a cadence prediction result for the voice unit represented by this phonogram string is generated by the cadence prediction section 52. The acoustic processor 41 then generates speech waveform data representing waveforms of speech represented by the respective phonograms included in the phonogram string based on the respective phoneme fragment waveform data that was decompressed and the cadence prediction data, and supplies the generated speech waveform data to the output synthesis section 53.

In this connection, the matching voice unit decision section 51 may also supply to the acoustic processor 41 from the cadence prediction data supplied to the matching voice unit decision section 51 that was already generated by the cadence prediction section 52, a part of the cadence prediction data that corresponds to a voice unit indicated by the missing part identification data. In this case, it is not necessary for the acoustic processor 41 to again cause the cadence prediction section 52 to carry out cadence prediction for the relevant voice unit. Thus, it is possible to produce speech that is more natural than in the case of performing cadence prediction for each minute unit such as a voice unit.

When the output synthesis section 53 receives voice unit data from the matching voice unit decision section 51 and speech waveform data generated from phoneme fragment waveform data from the acoustic processor 41, by adjusting the number of phoneme fragment waveform data included in each of the speech waveform data that were supplied, it adjusts the duration of the speech represented by the speech waveform data such that it matches the utterance speed of the voice unit represented by the voice unit data that was supplied by the matching voice unit decision section 51.

More specifically, the output synthesis section 53, for example, may identify a ratio at which the durations of phonemes represented by each of the aforementioned segments included in the voice unit data from the matching voice unit decision section 51 increased or decreased with respect to the original duration, and then increase or decrease the number of the phoneme fragment waveform data within the respective speech waveform data such that the durations of phonemes represented by the speech waveform data supplied by the acoustic processor 41 change in accordance with the ratio in question. In order to identify the ratio, for example, the output synthesis section 53 may acquire from the search section 6 the original voice unit data that was used to generate the voice unit data that was supplied by the matching voice unit decision section 51, and then identify, one at a time, segments representing phonemes that are the same in the two voice unit data. The output synthesis section 53 may then identify as the ratio of an increase or decrease in the duration of the phonemes, the ratio by which the number of phoneme fragments included in segments identified within the voice unit data supplied by the matching voice unit decision section 51 increased or decreased with respect to the number of phoneme fragments included in segments identified within the voice unit data that was acquired from the search section 6. In this connection, when the duration of a phoneme represented by the speech waveform data already matches the speed of a voice unit represented by voice unit data supplied by the matching voice unit decision section 51, there is no necessity for the output synthesis section 53 to adjust the number of phoneme fragment waveform data within the speech waveform data.

Thereafter, the output synthesis section 53 combines the speech waveform data for which adjustment of the number of phoneme fragment waveform data was completed and the voice unit data that was supplied by the matching voice unit decision section 51 in an order in accordance with the sequence of the phonemes or the respective voice units within the message template shown by the message template data, and outputs the resulting data as data representing synthetic speech.

When missing part identification data is not included in the data supplied by the utterance speed converter 9, the voice unit editor 5 does not instruct the acoustic processor 41 to synthesize a waveform, and immediately combines the selected voice unit data together in an order in accordance with the sequence of the phonogram string in the message template shown by the message template data, and outputs the resulting data as data representing synthetic speech.

As described above, according to the speech synthesis system of the second embodiment of this invention, voice unit data representing the waveforms of voice units that may be in units larger than a phoneme are naturally joined together by a recorded speech editing method based on a cadence prediction result, to thereby synthesize speech that reads aloud a message template.

In contrast, a voice unit for which suitable voice unit data could not be selected is synthesized according to a technique according to a synthesis by rule system by using compressed waveform data representing phoneme fragments as units that are smaller than a phoneme. Since the compressed waveform data represents the waveforms of phoneme fragments, the storage capacity of the waveform database 44 can be smaller than a case in which the compressed waveform data represents phoneme waveforms, and searching can be performed at a high speed. As a result, a small and lightweight configuration can be adopted for this speech synthesis system and high-speed processing can also be achieved.

Further, by performing speech synthesis by rule using phoneme fragments, unlike the case of performing speech synthesis by rule using phonemes, speech synthesis can be carried out without coming under the influence of particular waveforms that appear at the edges of phonemes, and a natural sound can thus be obtained with a small number of phoneme fragment types.

More specifically, it is known that in human speech particular waveforms appear at the boundary of a transition from a preceding phoneme to the following phoneme that receive the influence of both of these phonemes. Meanwhile, since phonemes used in speech synthesis by rule already include this particular waveform at their edges at the collection stage, when conducting speech synthesis by rule using phonemes it is necessary to prepare a vast amount of phoneme types in order to be able to reproduce various patterns of waveforms at the boundaries between phonemes or else to be satisfied with synthesizing synthetic speech in which the waveforms at the boundaries between phonemes are different to natural speech. However, when performing speech synthesis by rule using phoneme fragments it is possible to eliminate in advance the influence of the particular waveforms that are present at the boundaries between phonemes by collecting the phoneme fragments from parts other than the edges of phonemes. Thus, natural speech can be produced without the need to prepare a vast amount of phoneme fragment types.

In this connection, the configuration of the speech synthesis system according to the second embodiment of this invention is also not limited to the configuration described above.

For example, it is not necessary that phoneme fragment waveform data be PCM format data, and an arbitrary data format may be used. Further, the waveform database 44 need not necessarily store phoneme fragment waveform data and voice unit data in a condition in which the data was compressed. When the waveform database 44 stores phoneme fragment waveform data in a condition in which the data is not compressed, it is not necessary for the main unit M2 to comprise the decompression section 43.

Further, the waveform database 44 need not necessarily store the waveforms of phoneme fragments in a form in which they are separated individually. For example, a configuration may be adopted in which the waveform of speech comprising a plurality of phoneme fragments is stored with data identifying the positions that individual phoneme fragments occupy in the waveform. In this case, the voice unit database 7 may perform the function of the waveform database 44.

In addition, similarly to the voice unit editor 5 of the first embodiment, the matching voice unit decision section 51 may be configured to previously store cadence registration data, and when the particular voice unit is included in a message template the matching voice unit decision section 51 may handle the cadence represented by this cadence registration data as a cadence prediction result, or may be configured to newly store a past cadence prediction result as cadence registration data.

The matching voice unit decision section 51 may also acquire free text data or delivery character string data in a similar manner to the voice unit editor 5 of the first embodiment, and select voice unit data representing a waveform that is close to the waveform of a voice unit included in the free text or delivery character string represented by the acquired data by performing processing that is substantially the same as processing that selects voice unit data representing a waveform that is close to the waveform of a voice unit included in a message template, and then use the selected voice unit data for speech synthesis. In this case, with respect to the voice unit represented by the voice unit data selected by the matching voice unit decision section 51, the acoustic processor 41 need not cause the search section 42 to search for waveform data representing the waveform of this voice unit. Further, the matching voice unit decision section 51 may notify the acoustic processor 41 of the voice unit that the acoustic processor 41 need not synthesize, and in response to this notification the acoustic processor 41 may cancel a search for the waveform of a speech unit comprising this voice unit.

The compressed waveform data stored by the waveform database 44 need not necessarily be data that represents phoneme fragments. For example, similarly to the first embodiment, the data may be waveform data representing the waveforms of speech units represented by phonograms stored by the waveform database 44, or may be data obtained by entropy coding of that waveform data.

Further, the waveform database 44 may store both data representing the waveforms of phoneme fragments and data representing the phoneme waveforms. In this case, the acoustic processor 41 may cause the search section 42 to retrieve the data of phonemes represented by phonograms included in a delivery character string or the like. For phonograms for which the corresponding phoneme could not be retrieved, the acoustic processor 41 may cause the search section 42 to retrieve data representing phoneme fragments comprising the phonemes represented by the phonograms in question, and then generate data representing the phonemes using the data representing phoneme fragments that was retrieved.

The method by which the utterance speed converter 9 causes the duration of a voice unit represented by voice unit data to match the speed shown by utterance speed data is arbitrary. Accordingly, the utterance speed converter 9 may, for example, in a similar manner to processing in the first embodiment, resample voice unit data supplied by the search section 6 and increase or decrease the number of samples of the voice unit data to obtain a number corresponding with a duration that matches the utterance speed designated by the matching voice unit decision section 51.

The main unit M2 need not necessarily comprise the utterance speed converter 9. When the main unit M2 does not comprise the utterance speed converter 9, the cadence prediction section 52 predicts the utterance speed, and the matching voice unit decision section 51 then selects from among the voice unit data acquired by the search section 6 the data for which the utterance speed matches the result predicted by the cadence prediction section 52 under predetermined criteria and, in contrast, excludes from the selection objects data for which the utterance speed does not match the prediction result. In this connection, the voice unit database 7 may store a plurality of voice unit data for which a reading of a voice unit is common but a utterance speed is different.

A method by which the output synthesis section 53 causes the duration of a phoneme represented by speech waveform data to match the utterance speed of a voice unit represented by voice unit data is also arbitrary. Accordingly, the output synthesis section 53, for example, may identify the ratio at which the durations of phonemes represented by the respective segments included in the voice unit data from the matching voice unit decision section 51 increased or decreased with respect to the original duration, resample the speech waveform data, and then increase or decrease the number of samples of the speech waveform data to a number corresponding to a duration that matches the utterance speed designated by the matching voice unit decision section 51.

The utterance speed may also vary for each voice unit. (Accordingly, the utterance speed data may be data specifying utterance speeds that differ for each voice unit.) Thus, the output synthesis section 53 may, for speech waveform data of each speech sound positioned between two voice units having mutually different utterance speeds, determine the utterance speed of these speech sounds positioned between the two voice units by interpolating (for example, linear interpolation) the utterance speeds of the two voice units in question, and then convert the speech waveform data representing these speech sounds such that the data matches the determined utterance speed.

Even when speech waveform data that was returned by the acoustic processor 41 is data representing speech that comprises speech that reads aloud free text or a delivery character string, the output synthesis section 53 may be configured to convert the speech waveform data such that the duration of the speech, for example, matches a speed indicated by utterance speed data supplied by the matching voice unit decision section 51.

In the above system, for example, the cadence prediction section 52 may perform cadence prediction (including utterance speed prediction) with respect to a complete sentence or may perform cadence prediction respectively for predetermined units. When performing cadence prediction with respect to a complete sentence, if a voice unit with a matching reading exists, the cadence prediction section 52 may also determine whether or not the cadence is matching within predetermined conditions, and if the cadence is matching the cadence prediction section 52 may adopt the voice unit in question. For a part for which a matching voice unit does not exist, the rule combination processor 4 may generate speech on the basis of the phoneme fragment and the pitch and speed of the part synthesized based on the phoneme fragment may be adjusted on the basis of the result of cadence prediction performed for the entire sentence or for each of the predetermined units. As a result, natural speech can be produced even when synthesizing speech by combining voice units and speech that was generated on the basis of phoneme fragments.

Further, when a character string input into the language processor 1 is a phonogram string, the language processor 1 may perform a known natural language analysis processing that is separate to the cadence prediction, and the matching voice unit decision section 51 may select a voice unit based on the result of the natural language analysis processing. It is thus possible to select voice units using results obtained by interpreting a character string for each word (parts of speech such as nouns or verbs), and produce speech that is more natural than that produced in the case of merely selecting voice units that match a phonogram string.

Although embodiments of this invention have been described above, the speech synthesis device of this invention is not limited to a dedicated system and can be implemented using an ordinary computer system.

For example, the main unit M1 that executes the above processing can be configured by installing into a personal computer a program that causes the personal computer to execute the operations of the above described language processor 1, general word dictionary 2, user word dictionary 3, acoustic processor 41, search section 42, decompression section 43, waveform database 44, voice unit editor 5, search section 6, voice unit database 7, decompression section 8 and utterance speed converter 9 from a recording medium (such as a CD-ROM, MO or floppy (registered trademark) disk) that stores the program.

Further, the voice unit registration unit R that executes the above processing can be configured by installing into a personal computer a program that causes the personal computer to execute the operations of the above described collected voice unit dataset storage section 10, voice unit database creation section 11 and compression section 12 from a medium that stores the program.

Figure 4:
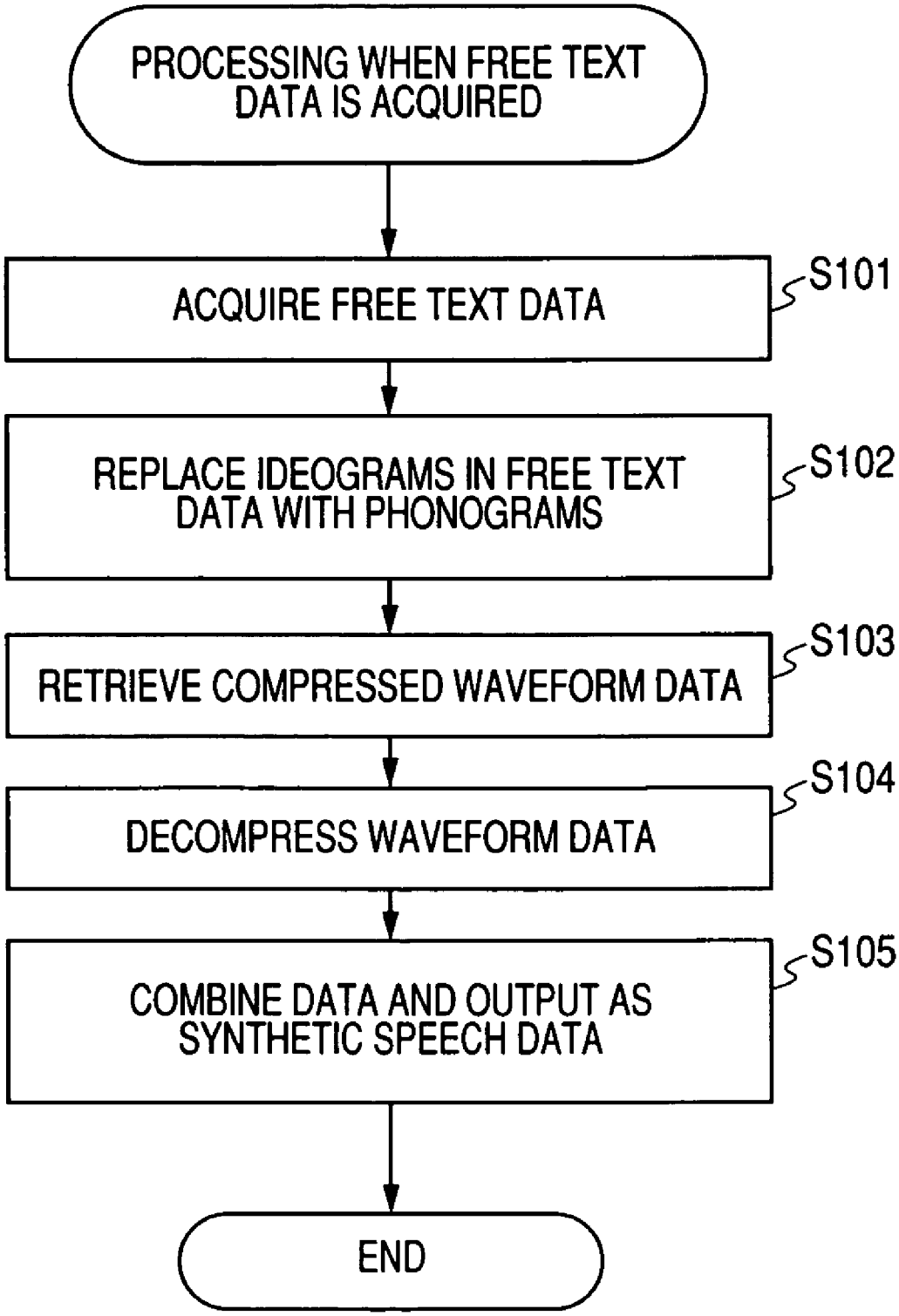
FIG. 4 is a flowchart showing processing in a case where a personal computer performing the functions of the speech synthesis system according to the first embodiment of this invention acquires free text data.
Figure 5:
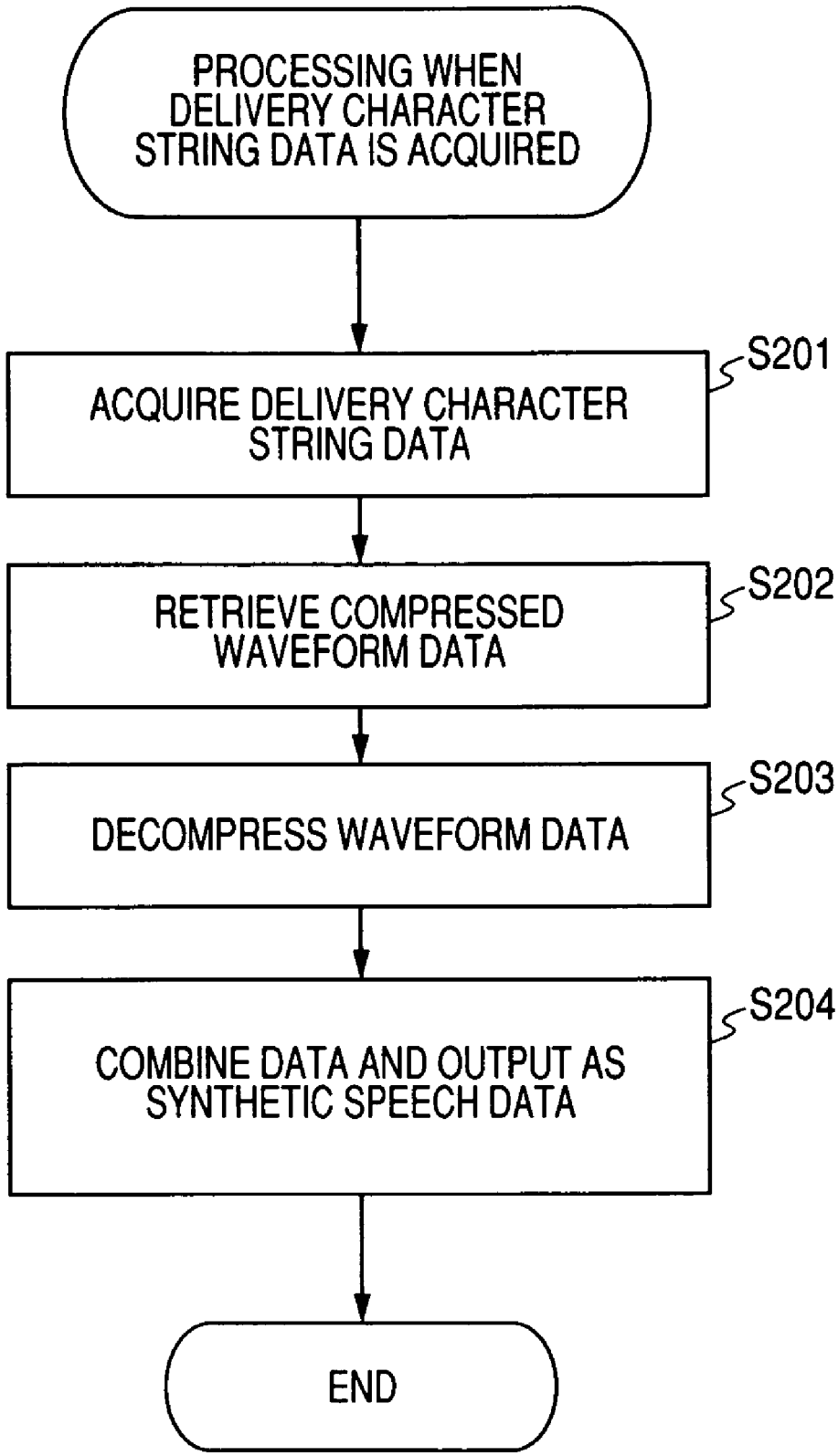
FIG. 5 is a flowchart showing processing in a case where a personal computer performing the functions of the speech synthesis system according to the first embodiment of this invention acquires delivery character string data.
Figure 6:
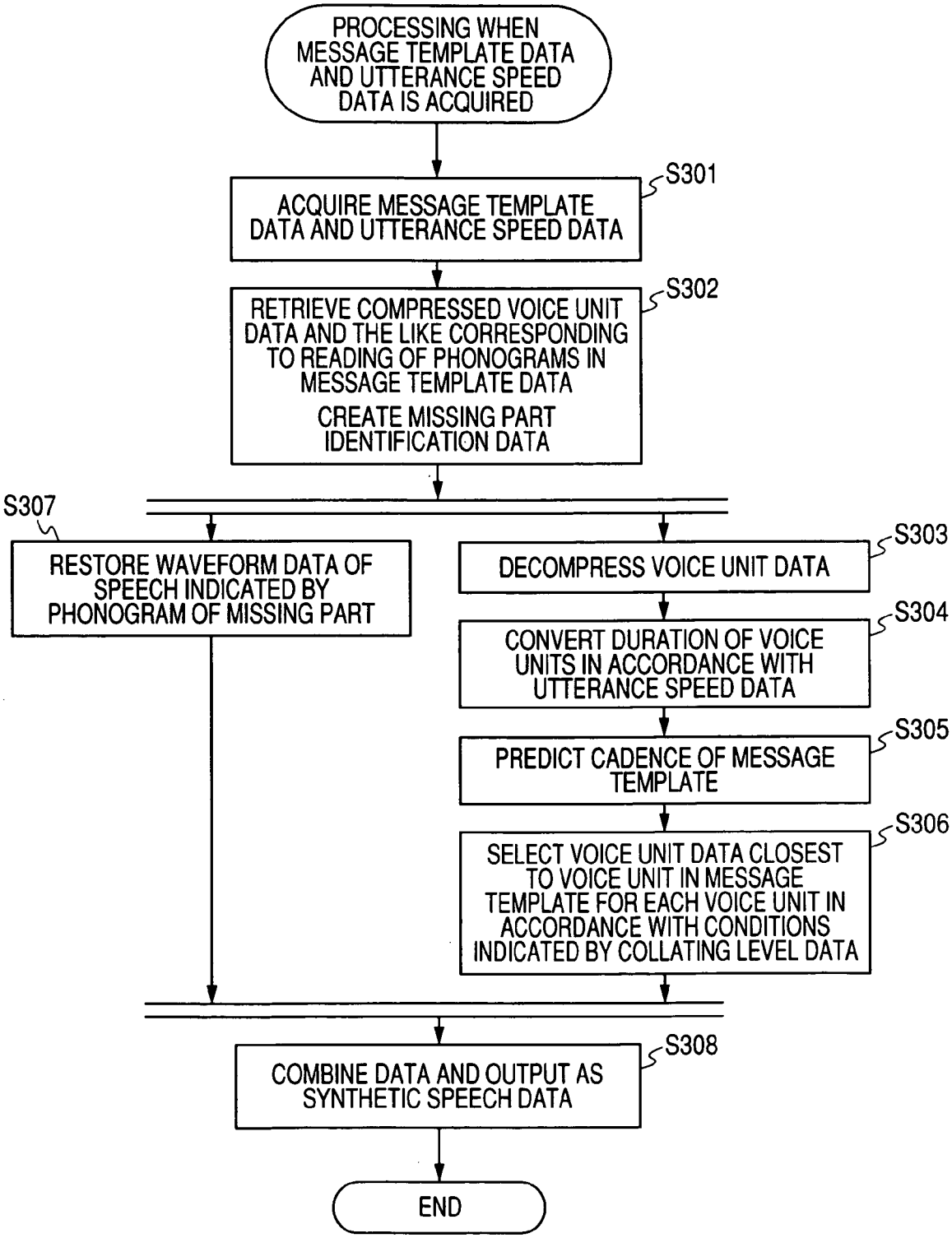
FIG. 6 is a flowchart showing processing in a case where a personal computer performing the functions of the speech synthesis system according to the first embodiment of this invention acquires message template data and utterance speed data.

A personal computer that implements these programs to function as the main unit M1 or voice unit registration unit R then performs the processing shown in FIG. 4 to FIG. 6 as processing corresponding to the operation of the speech synthesis system of FIG. 1.

FIG. 4 is a flowchart showing processing in a case where the personal computer acquires free text data.

FIG. 5 is a flowchart showing processing in a case where the personal computer acquires delivery character string data.

FIG. 6 is a flowchart showing processing in a case where the personal computer acquires message template data and utterance speed data.

More specifically, when the personal computer acquires from outside the above-described free text data (FIG. 4, step S101), for the respective ideograms included in the free text represented by the free text data, the personal computer identifies phonograms representing the reading thereof by searching the general word dictionary 2 and the user word dictionary 3 and replaces the ideograms with the thus-identified phonograms (step S102). The method by which the personal computer acquires free text data is arbitrary.

When the personal computer obtains a phonogram string representing the result obtained after replacing all the ideograms in the free text with phonograms, for each of the phonograms included in the phonogram string, the personal computer retrieves from the waveform database 44 the waveforms of speech units represented by the phonograms, and then retrieves compressed waveform data representing the waveforms of the speech units represented by the respective phonograms that are included in the phonogram string (step S103).

Next, the personal computer decompresses the compressed waveform data that was retrieved to restore the waveform data to the same condition as prior to compression (step S104), combines together the decompressed waveform data in an order in accordance with the sequence of the respective phonograms in the phonogram string, and outputs the resulting data as synthetic speech data (step S105). The method by which the personal computer outputs the synthetic speech data is arbitrary.

Further, when the personal computer acquires from outside the above-described delivery character string data by an arbitrary method (FIG. 5, step S201), for the respective phonograms included in the phonogram string represented by the delivery character string data, the personal computer retrieves from the waveform database 44 the waveforms of speech units represented by the phonograms, and then retrieves compressed waveform data representing the waveforms of the speech units represented by the respective phonograms that are included in the phonogram string (step S202).

Next, the personal computer decompresses the compressed waveform data that was retrieved to restore the waveform data to the same condition as prior to compression (step S203), combines together the decompressed waveform data in an order in accordance with the sequence of the respective phonograms in the phonogram string, and outputs the resulting data as synthetic speech data by processing that is the same as the processing of step S105 (step S204).

When the personal computer acquires from outside the above-described message template data and utterance speed data by an arbitrary method (FIG. 6, step S301), the personal computer first retrieves all the compressed voice unit data with which phonograms are associated that match phonograms representing the reading of voice units included in the message template represented by the message template data (step S302).

Further, in step S302 the personal computer also retrieves the above-described voice unit reading data, speed initial value data and pitch component data that are associated with the compressed voice unit data in question. In this connection, when a plurality of compressed voice unit data correspond to a single voice unit, all of the corresponding compressed voice unit data are retrieved. In contrast, when a voice unit exists for which compressed voice unit data could not be retrieved the personal computer generates the above-described missing part identification data.

Next, the personal computer decompresses the compressed voice unit data that was retrieved to restore the voice unit data to the same condition as prior to compression (step S303). The personal computer then converts the decompressed voice unit data by processing that is the same as processing performed by the above voice unit editor 5 such that the duration of a voice unit represented by the voice unit data in question matches the speed indicated by the utterance speed data (step S304). In this connection, when no utterance speed data has been supplied the decompressed voice unit data need not be converted.

Subsequently, the personal computer predicts the cadence of the message template by analyzing the message template represented by the message template data based on a cadence prediction method (step S305). Then, from among the voice unit data for which the duration of the voice unit was converted, the personal computer selects, one at a time for each voice unit, voice unit data representing the waveforms that are closest to the waveforms of the voice units comprising the message template in accordance with criteria indicated by collating level data acquired from outside, by performing processing similar to processing performed by the above voice unit editor 5 (step S306).

More specifically, in step S306 the personal computer, for example, identifies voice unit data in accordance with the conditions of the above-described (1) to (3). That is, when the value of the collating level data is "1", the personal computer regards all voice unit data whose reading matches that of a voice unit in the message template as representing the waveform of a voice unit within the message template. When the value of the collating level data is "2", the personal computer regards the voice unit data as representing the waveform of a voice unit within the message template only when the phonogram representing the reading matches and, furthermore, the contents of pitch component data representing time variations in the pitch component frequency of the voice unit data matches with a prediction result for the accent of a voice unit included in the message template. Further, when the value of the collating level data is "3", the personal computer regards the voice unit data as representing the waveform of a voice unit within the message template only when the phonogram representing the reading and the accent are matching, and furthermore, the presence or absence of nasalization or devocalization of a speech sound represented by the voice unit data matches the cadence prediction result of the message template.

When there are a plurality of voice unit data that match the criteria indicated by the collating level data for a single voice unit, these plurality of voice unit data are narrowed down to a single candidate in accordance with conditions that are more stringent than the set conditions.

Meanwhile, when the personal computer generated missing part identification data, the personal computer extracts a phonogram string that represents the reading of the voice unit indicated by the missing part identification data from the message template data, and by handling this phonogram string in the same manner as a phonogram string represented by delivery character string data and performing the processing of the above steps S202 to S203 for each phoneme, the personal computer reconstructs waveform data representing the waveforms of speech represented by each phonogram within the phonogram string (step S307).

The personal computer then combines the reconstructed waveform data and the voice unit data that was selected in step S306 in an order in accordance with the sequence of the phonogram string in the message template shown by the message template data, and outputs this data as data representing synthetic speech (step S308).

Furthermore, for example, the main unit M2 that executes the above processing can be configured by installing into a personal computer a program that causes the personal computer to execute the operations of the language processor 1, general word dictionary 2, user word dictionary 3, acoustic processor 41, search section 42, decompression section 43, waveform database 44, voice unit editor 5, search section 6, voice unit database 7, decompression section 8 and utterance speed converter 9 of FIG. 3 from a recording medium that stores the program.

Figure 7:
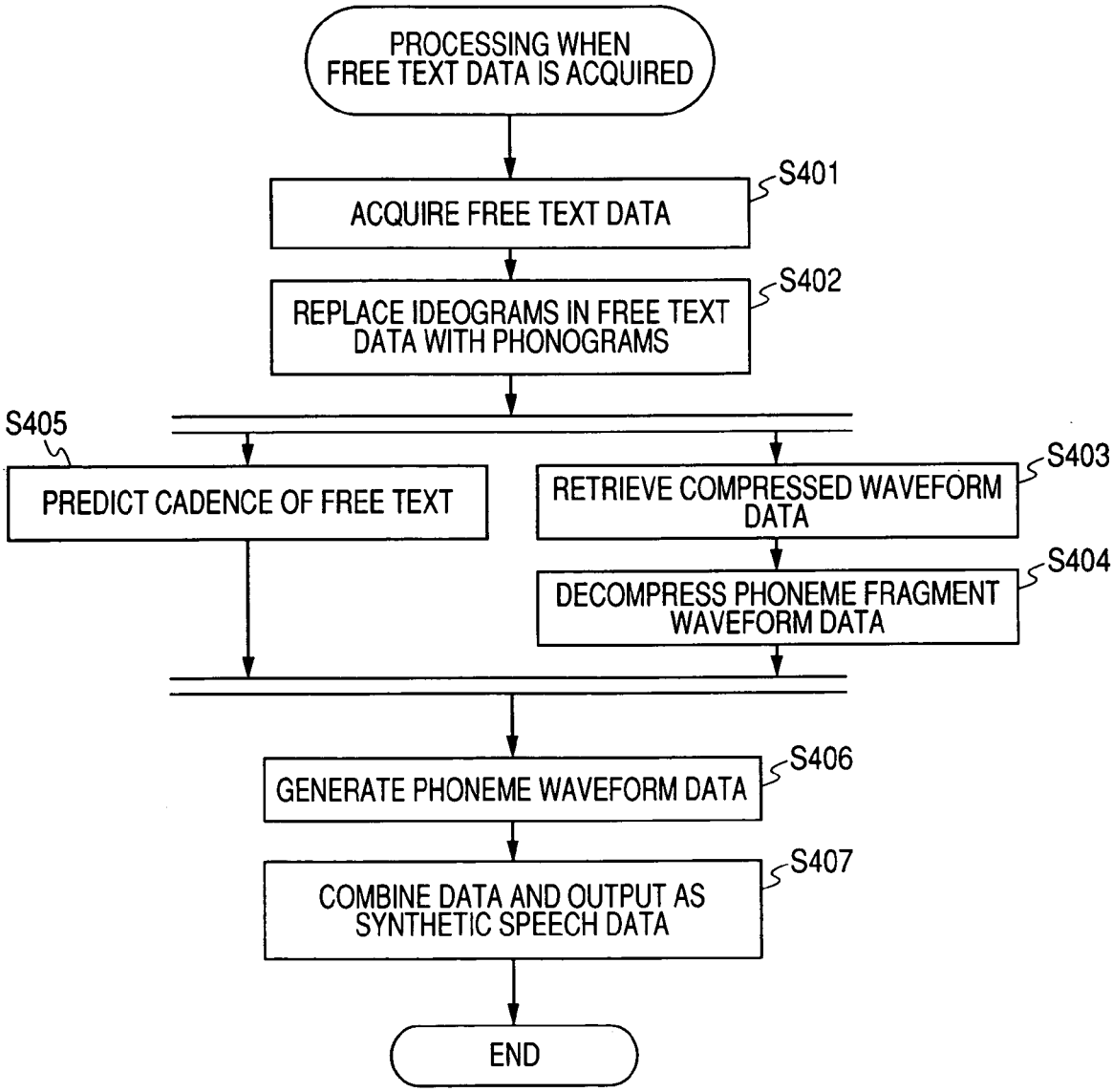
FIG. 7 is a flowchart showing processing in a case where a personal computer performing the functions of the main unit of FIG. 3 acquires free text data.
Figure 8:
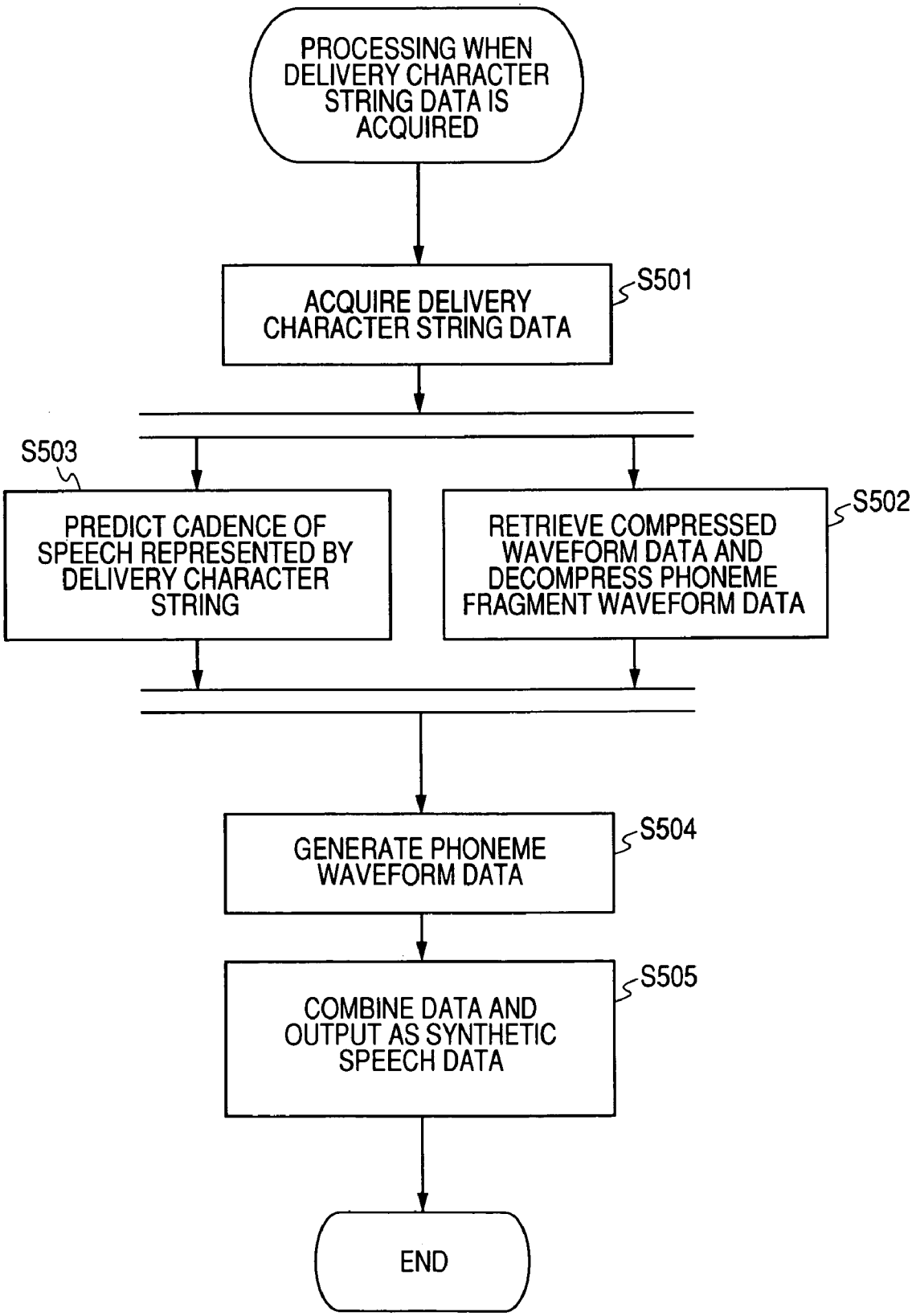
FIG. 8 is a flowchart showing processing in a case where a personal computer performing the functions of the main unit of FIG. 3 acquires delivery character string data.
Figure 9:
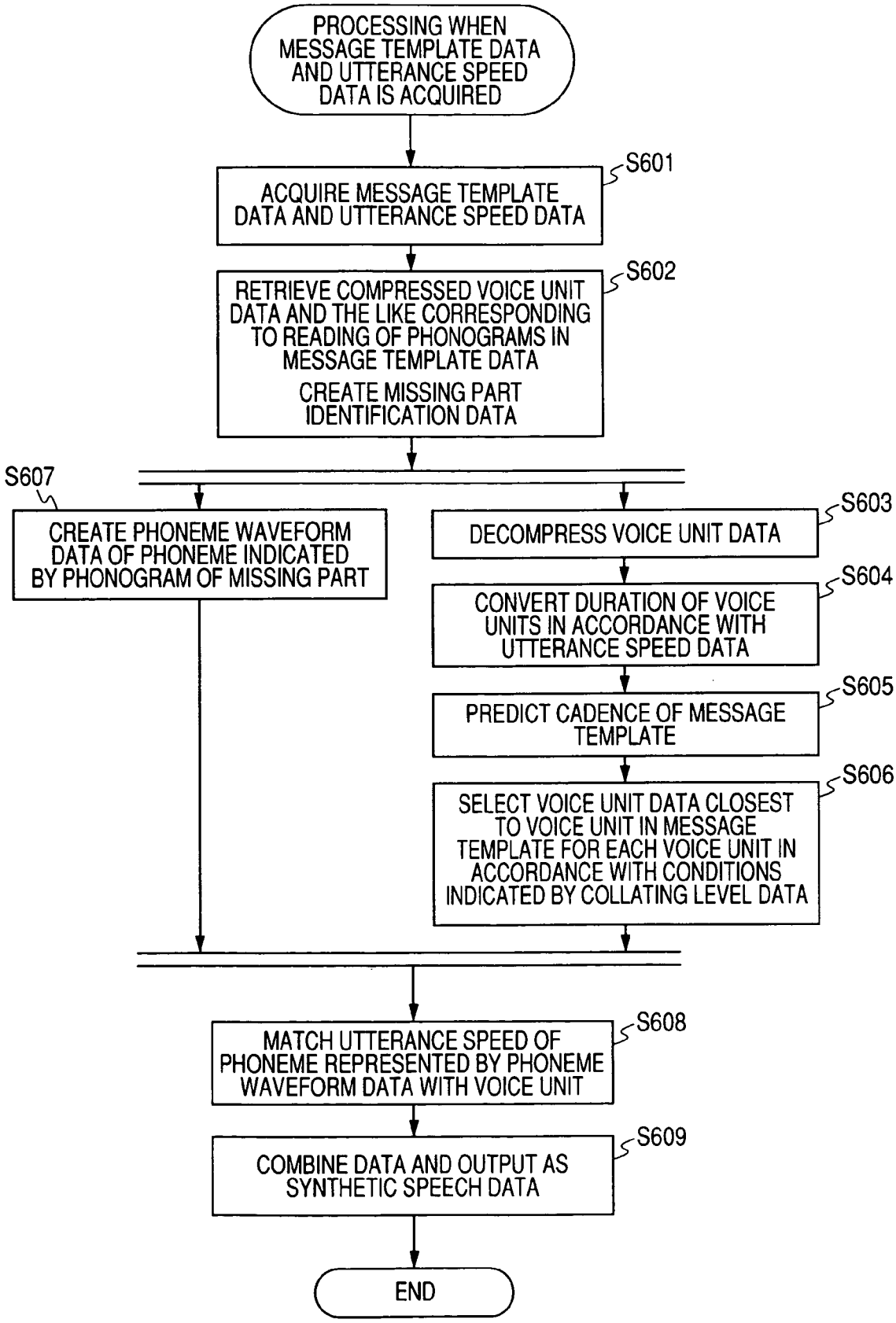
FIG. 9 is a flowchart showing processing in a case where a personal computer performing the functions of the main unit of FIG. 3 acquires message template data and utterance speed data.

A personal computer that implements this program to function as the main unit M2 can also be configured to perform the processing shown in FIG. 7 to FIG. 9 as processing corresponding to the operation of the speech synthesis system of FIG. 3.

FIG. 7 is a flowchart showing the processing in a case where the personal computer performing the functions of the main unit M2 acquires free text data.

FIG. 8 is a flowchart showing the processing in a case where the personal computer performing the functions of the main unit M2 acquires delivery character string data.

FIG. 9 is a flowchart showing the processing in a case where the personal computer performing the functions of the main unit M2 acquires message template data and utterance speed data.

More specifically, when the personal computer acquires from outside the above-described free text data (FIG. 7, step S401), for the respective ideograms included in the free text represented by the free text data, the personal computer identifies phonograms representing the reading thereof by searching the general word dictionary 2 or the user word dictionary 3, and replaces the ideograms with the thus-identified phonograms (step S402). The method by which the personal computer acquires free text data is arbitrary.

When the personal computer obtains a phonogram string representing the result obtained by replacing all the ideograms in the free text with phonograms, for each of the phonograms included in the phonogram string the personal computer retrieves from the waveform database 44 the waveform of a speech unit represented by the phonogram, and then retrieves compressed waveform data representing the waveforms of phoneme fragments comprising the phonemes represented by the respective phonograms included in the phonogram string (step S403), and decompresses the compressed waveform data that was retrieved to restore the phoneme fragment waveform data to the same condition as prior to compression (step S404).

Meanwhile, the personal computer predicts the cadence of speech represented by the free text by analyzing the free text data on the basis of a cadence prediction method (step S405). The personal computer then generates speech waveform data on the basis of the phoneme fragment waveform data that was decompressed in step S404 and the cadence prediction result from step S405 (step S406), and combines together the obtained speech waveform data in an order in accordance with the sequence of the respective phonograms within the phonogram string and outputs the resulting data as synthesized speech data (step S407). The method by which the personal computer outputs synthetic speech data is arbitrary.

Further, when the personal computer acquires from outside the above-described delivery character string data by an arbitrary method (FIG. 8, step S501), for the respective phonograms included in the phonogram string represented by the delivery character string data, similarly to the above steps S403 to S404, the personal computer performs processing to retrieve compressed waveform data representing the waveforms of phoneme fragments comprising the phonemes represented by the respective phonograms and processing to decompress the retrieved compressed waveform data to restore the phoneme fragment waveform data to the same condition as prior to compression (step S502).

Meanwhile, the personal computer predicts the cadence of speech represented by the delivery character string by analyzing the delivery character string based on a cadence prediction method (step S503), and generates speech waveform data on the basis of the phoneme fragment waveform data that was decompressed in step S502 and the cadence prediction result from step S503 (step S504). Thereafter, the personal computer combines together the obtained speech waveform data in an order according to the sequence of the respective phonograms in the phonogram string, and outputs this data as synthetic speech data by performing processing that is the same as the processing performed in step S407 (step S505).

In contrast, when the personal computer acquires from outside the above-described message template data and utterance speed data by an arbitrary method (FIG. 9, step S601), the personal computer first retrieves all the compressed voice unit data which are associated with phonograms that match phonograms representing the reading of voice units included in the message template represented by the message template data (step S602).

In step S602 the personal computer also retrieves the above-described voice unit reading data, speed initial value data and pitch component data that are associated with the compressed voice unit data in question. In this connection, when a plurality of compressed voice unit data correspond to a single voice unit, all of the corresponding compressed voice unit data are retrieved. In contrast, when a voice unit exists for which compressed voice unit data could not be retrieved the personal computer generates the above-described missing part identification data.

Next, the personal computer decompresses the compressed voice unit data that was retrieved to restore the phoneme fragment voice unit data to the same condition as prior to compression (step S603). The personal computer then converts the decompressed voice unit data by performing processing that is the same as processing performed by the above output synthesis section 53 such that the duration of a voice unit represented by the voice unit data matches the speed shown by the utterance speed data (step S604). In this connection, when no utterance speed data has been supplied it is not necessary to convert the decompressed voice unit data.

Next, the personal computer predicts the cadence of the message template by analyzing the message template represented by the message template data using a cadence prediction method (step S605). Then, the personal computer selects from the voice unit data for which the duration of the voice unit was converted, voice unit data representing waveforms that are closest to the waveforms of the voice units comprising the message template in accordance with criteria indicated by collating level data that was acquired from outside. This processing is carried out one at a time for each voice unit by performing processing similar to processing performed by the above matching voice unit decision section 51 (step S606).

More specifically, in step S606 the personal computer, for example, identifies voice unit data in accordance with the conditions of the above-described (1) to (3) by performing processing that is the same as the processing of the above step S306. When there are a plurality of voice unit data that match the criteria indicated by the collating level data for a single voice unit, these plurality of voice unit data are narrowed down to a single candidate in accordance with conditions that are more stringent than the set conditions. Further, when a voice unit exists for which voice unit data fulfilling the conditions corresponding to the collating level data value could not be selected, the personal computer handles the voice unit in question as a voice unit for which compressed voice unit data could not be retrieved and, for example, generates missing part identification data.

When the personal computer generated missing part identification data, the personal computer extracts a phonogram string that represents the reading of the voice unit indicated by the missing part identification data from the message template data, and by handling this phonogram string in the same manner as a phonogram string represented by delivery character string data and performing the same processing as in the above steps S502 to S503 for each phoneme, the personal computer generates, speech waveform data representing the waveforms of speech indicated by each phonogram within the phonogram string (step S607).

In step S607, instead of performing processing corresponding to the processing of step S503, the personal computer may generate speech waveform data using the cadence prediction result of step S605.

Next, by performing processing that is the same as that performed by the above output synthesis section 53, the personal computer adjusts the number of phoneme fragment waveform data included in the speech waveform data generated in step S607 such that the duration of speech represented by the speech waveform data conforms with the utterance speed of the voice unit represented by the voice unit data selected in step S606 (step S608).

More specifically, in step S608, the personal computer, for example, may identify the ratio by which the durations of phonemes represented by the above-described respective segments included in the voice unit data selected in step S606 increased or decreased with respect to the original duration, and then increase or decrease the number of the phoneme fragment waveform data within the respective speech waveform data such that the durations of speech represented by the speech waveform data generated in step S607 change in accordance with the ratio. In order to identify the ratio, for example, the personal computer may identify, one at a time, segments representing speech that are the same in both the voice unit data selected in step S606 (voice unit data after utterance speed conversion) and the original voice unit data in a condition prior to the voice unit data undergoing conversion in step S604, and then identify as the ratio of increase or decrease in the duration of the speech the ratio by which the number of phoneme fragments included in the segments identified within the voice unit data after utterance speed conversion increased or decreased with respect to the number of phoneme fragments included in the segments identified within the original voice unit data. In this connection, when the duration of speech represented by the speech waveform data already matches the speed of a voice unit represented by voice unit data after conversion, there is no necessity for the personal computer to adjust the number of phoneme fragment waveform data within the speech waveform data.

The personal computer then combines the speech waveform data that underwent the processing of step S608 and the voice unit data that was selected in step S606 in an order in accordance with the sequence of the phonogram string in the message template shown by the message template data, and outputs this data as data representing synthetic speech (step S609).

In this connection, programs that cause a personal computer to perform the functions of the main unit M1, the main unit M2 or the voice unit registration unit R, for example, may be uploaded to a bulletin board system (BBS) of a communication line and distributed through a communication line. Alternatively, a method may be adopted in which carrier waves are modulated by signals representing these programs, the obtained modulated waves are then transmitted, and a device that received the modulated waves demodulates the modulated waves to restore the programs to their original state.

The above-described processing can then be executed by activating these programs and executing them in a similar manner as other applications under the control of an operating system.

In this connection, when the operating system shares a part of the processing or when the operating system comprises a part of one component of this invention, a program that excludes that part may be stored on a recording medium. In this case also, according to this invention it shall be assumed that a program for executing each function or step executed by a computer is stored on the recording medium.

The invention claimed is:

1. A speech synthesis device, comprising:

voice unit storage means for storing a plurality of pieces of voice unit data representing voice units;

phoneme storage means for storing a plurality of pieces of phoneme data each of which is a phoneme or comprises phoneme fragments composing a phoneme;

cadence prediction means for inputting sentence information representing a sentence to predict the cadence of voice units composing the sentence;

selecting means using a processor for selecting voice unit data satisfying predetermined conditions out of the plurality of pieces of voice unit data stored in the voice unit storage means, wherein the predetermined conditions are that the voice unit data to be selected matches in its reading with the voice unit composing the sentence and has a correlation greater than a predetermined amount with a cadence prediction result by the cadence prediction means;

missing part cadence prediction means using a processor for predicting the cadence of voice units which have been decided not to satisfy the predetermined conditions by the selection means;

missing part synthesis means using a processor for specifying phonemes contained in the voice unit decided not to satisfy the predetermined condition by the selection means out of the voice units composing the sentence, for acquiring phoneme data representing the specified phoneme or phoneme fragments composing the specified phoneme from the phoneme storage means, for converting the acquired phoneme data so that the phoneme or phoneme fragments represented by the acquired phoneme data matches with a cadence prediction result by the missing part cadence prediction means, and for interconnecting the converted data, thereby synthesizing speech data representing a waveform of the voice unit; and creation means for interconnecting the voice unit data selected by the selection means and the speech data synthesized by the missing part synthesis means, thereby creating data representing synthesis speech.

2. The speech synthesis device according to claim 1, wherein the selection means selects the voice unit data out of the plurality of pieces of voice unit data stored in the voice unit storage means under the predetermined conditions further including that the presence or absence of nasalization or devocalization of the voice unit data matches with the cadence prediction result by the cadence prediction means.

3. The speech synthesis device according to claim 2, wherein the voice unit storage means operates to associate phonetic data representing a reading of voice unit with the voice unit data, and the selection means operates to handle voice unit data which is associated with phonetic data representing a reading matching with the reading of the voice unit composing the sentence, as voice unit whose reading is common with the voice unit.

4. The speech synthesis device according to claim 2, wherein the device further comprises utterance speed conversion means for acquiring utterance speed data specifying conditions of a speed for producing the synthesis speech created by the creation means and for converting the voice unit data and/or speech data so as to represent a speech to be produced at a speed satisfying the conditions specified by the utterance speed data.

5. The speech synthesis device according to claim 4, wherein the voice unit storage means operates to associate phonetic data representing a reading of voice unit with the voice unit data, and the selection means operates to handle voice unit data which is associated with phonetic data representing a reading matching with the reading of the voice unit composing the sentence, as voice unit whose reading is common with the voice unit.

6. The speech synthesis device according to claim 4, wherein the utterance speed conversion means operates to convert the voice unit data and/or the speech data so as to represent a speech to be uttered at a speed to be produced at a speed satisfying the conditions specified by the utterance speed data, by eliminating a segment representing a phoneme fragment from voice unit data and/or speech data composing data representing the synthesis speech or by adding a segment representing a phoneme fragment to the voice unit data and/or speech data.

7. The speech synthesis device according to claim 6, wherein the voice unit storage means operates to associate phonetic data representing a reading of voice unit with the voice unit data, and the selection means operates to handle voice unit data which is associated with phonetic data representing a reading matching with the reading of the voice unit composing the sentence, as voice unit whose reading is common with the voice unit.

8. The speech synthesis device according to claim 1, wherein the voice unit storage means operates to associate phonetic data representing a reading of voice unit with the voice unit data, and the selection means operates to handle voice unit data which is associated with phonetic data representing a reading matching with the reading of the voice unit composing the sentence, as voice unit whose reading is common with the voice unit.

9. A speech synthesis method performed by a speech synthesis device having storage means and processing means, the method comprising the steps of:

storing in the storage means a plurality of pieces of voice unit data representing voice units;

storing in the storage means a plurality of pieces of phoneme data each of which is a phoneme or comprises phoneme fragments composing a phoneme;

inputting in the processing means sentence information representing a sentence to predict the cadence of voice units composing the sentence;

selecting, in the processing means, voice units satisfying predetermined conditions out of the plurality of pieces of voice unit data stored in the storage means, wherein the predetermined conditions are that the voice unit data to be selected matches in its reading with the voice unit composing the sentence and has a correlation greater than a predetermined amount with a cadence prediction result;

predicting in the processing means the cadence of voice units which have been decided not to satisfy the predetermined conditions;

in the processing means, specifying phonemes contained in the voice unit decided not to satisfy the predetermined conditions out of the voice units composing the sentence, acquiring phoneme data representing the specified phoneme or phoneme fragments composing the specified phoneme from the storage means, converting the acquired phoneme data so that the phoneme or phoneme fragments represented by the acquired phoneme data matches with a cadence prediction result, and interconnecting the converted data, thereby synthesizing speech data representing a waveform of the voice unit; and in the processing means, interconnecting the selected voice unit data and the synthesis speed data, thereby creating data representing synthesis speech.

10. The speech synthesis method according to claim 9, wherein the processing means operates to select the voice unit data out of the plurality of pieces of voice unit data stored in the storage means under the predetermined conditions further including that the presence or absence of nasalization or devocalization of the voice unit data matches with the cadence prediction result.

11. A computer readable medium which records a computer program causing a computer to operate as:

voice unit storage means for storing a plurality of pieces of voice unit data representing voice units;

phoneme storage means for storing a plurality of pieces of phoneme data each of which is a phoneme or comprises phoneme fragments composing a phoneme;

cadence prediction means for inputting sentence information representing a sentence to predict the cadence of voice, units comprising the sentence;

selecting means for selecting voice unit data satisfying predetermined conditions out of the plurality of pieces of voice unit data stored in the voice unit storage means, wherein the predetermined conditions are that the voice unit data to be selected matches in its reading with the voice unit composing the sentence and has a correlation greater than a predetermined amount with a cadence prediction result by the cadence prediction means;

missing part cadence prediction means for predicting the cadence of voice units which have been decided not to satisfy the predetermined conditions by the selection means;

missing part synthesis means for specifying phonemes contained in the voice unit decided not to satisfy the predetermined condition by the selection means out of the voice units composing the sentence, for acquiring phoneme data representing the specified phoneme or phoneme fragments composing the specified phoneme from the phoneme storage means, for converting the acquired phoneme data so that the phoneme or phoneme fragments represented by the acquired phoneme data matches with a cadence prediction result by the missing part cadence prediction means, and for interconnecting the converted data, thereby synthesizing speech data representing a waveform of the voice unit; and creation means for interconnecting the voice unit data selected by the selection means and the speech data synthesized by the missing part synthesis means, thereby creating data representing synthesis speech.

12. The computer readable medium according to claim 11, wherein the selection means selects the voice unit data out of the plurality of pieces of voice unit data stored in the voice unit storage means under the predetermined conditions further including that the presence or absence of nasalization or devocalization of the voice unit data matches with the cadence prediction result by the cadence prediction means.

* * * * *